US009972234B2

(12) United States Patent
Nishiguchi

(10) Patent No.: US 9,972,234 B2
(45) Date of Patent: May 15, 2018

(54) DISPLAY DEVICE AND METHOD FOR PROCESSING DATA IN DISPLAY DEVICE

(71) Applicant: Sharp Kabushiki Kaisha, Sakai, Osaka (JP)

(72) Inventor: Takenobu Nishiguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days. days.

(21) Appl. No.: 15/513,999

(22) PCT Filed: Aug. 5, 2015

(86) PCT No.: PCT/JP2015/072238
§ 371 (c)(1),
(2) Date: Mar. 24, 2017

(87) PCT Pub. No.: WO2016/059856
PCT Pub. Date: Apr. 21, 2016

(65) Prior Publication Data

US 2017/0278445 A1 Sep. 28, 2017

(30) Foreign Application Priority Data

Oct. 15, 2014 (JP) ..... 2014-210447

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 2310/0235* (2013.01); *G09G 2310/08* (2013.01); *G09G 2370/12* (2013.01)

(58) Field of Classification Search
CPC .. G09G 3/20; G09G 3/3648; G09G 2330/021; G09G 2300/043
See application file for complete search history.

(56) References Cited

U.S. PATENT DOCUMENTS 5,838,299 A * 11/1998 Smith ..... G09G 5/395 345/604
2009/0260043 A1* 10/2009 Tatsuta ..... G09G 5/006 725/81

(Continued)

FOREIGN PATENT DOCUMENTS

JP 2001-331142 A 11/2001

*Primary Examiner* — Olga Merkoulova
(74) *Attorney, Agent, or Firm* — Keating & Bennett, LLP

(57) ABSTRACT

A display device employing a field sequential system is realized, that can transfer video data for field sequential among a plurality of substrates through a general standard interface. In a display device including a first circuit substrate (10) having a signal processing circuit (100), and a second circuit substrate (20) having liquid crystal timing controllers (200), the signal processing circuit (100) is provided with a signal separation circuit (110) configured to separate an input image signal (DIN) for one frame period into first intermediate data on a field basis, and a rearrangement circuit (120) configured to convert the first intermediate data to second intermediate data having a format depending on a standardized interface, and to rearrange the second intermediate data so that data for a plurality of rows is simulatively put together as data for one row, by which field data is generated.

9 Claims, 20 Drawing Sheets

(56) References Cited

U.S. PATENT DOCUMENTS

| | | | | |
|---|---|---|---|---|
| 2011/0216242 | A1* | 9/2011 | Kabuto | H04N 5/445<br>348/554 |
| 2014/0104249 | A1* | 4/2014 | Furihata | G09G 3/3674<br>345/204 |

* cited by examiner

Fig.9

| | | | | | | |
|---|---|---|---|---|---|---|
| W(1, 1) | W(2, 1) | W(3, 1) | ⋯ | W(958, 1) | W(959, 1) | W(960, 1) |
| W(1, 2) | W(2, 2) | W(3, 2) | ⋯ | W(958, 2) | W(959, 2) | W(960, 2) |
| ⋮ | ⋮ | ⋮ | ⋮ | ⋮ | ⋮ | ⋮ |
| W(1, 1079) | W(2, 1079) | W(3, 1079) | ⋯ | W(958, 1079) | W(959, 1079) | W(960, 1079) |
| W(1, 1080) | W(2, 1080) | W(3, 1080) | ⋯ | W(958, 1080) | W(959, 1080) | W(960, 1080) |

Fig.12

320 PIXELS × 30 BITS

80 PIXELS × 30 BITS

ONE PIXEL

| | | | | | | | | | | | |
|---|---|---|---|---|---|---|---|---|---|---|---|
| W(1, 1)<br>W(2, 1)<br>W(3, 1) | ····· | W(238, 1)<br>W(239, 1)<br>W(240, 1) | W(241, 1)<br>W(242, 1)<br>W(243, 1) | ····· | W(478, 1)<br>W(479, 1)<br>W(480, 1) | W(481, 1)<br>W(482, 1)<br>W(483, 1) | ····· | W(718, 1)<br>W(719, 1)<br>W(720, 1) | W(721, 1)<br>W(722, 1)<br>W(723, 1) | ····· | W(958, 1)<br>W(959, 1)<br>W(960, 1) |
| W(1, 2)<br>W(2, 2)<br>W(3, 2) | ····· | W(238, 2)<br>W(239, 2)<br>W(240, 2) | W(241, 2)<br>W(242, 2)<br>W(243, 2) | ····· | W(478, 2)<br>W(479, 2)<br>W(480, 2) | W(481, 2)<br>W(482, 2)<br>W(483, 2) | ····· | W(718, 2)<br>W(719, 2)<br>W(720, 2) | W(721, 2)<br>W(722, 2)<br>W(723, 2) | ····· | W(958, 2)<br>W(959, 2)<br>W(960, 2) |
| W(1, 3)<br>W(2, 3)<br>W(3, 3) | ····· | W(238, 3)<br>W(239, 3)<br>W(240, 3) | W(241, 3)<br>W(242, 3)<br>W(243, 3) | ····· | W(478, 3)<br>W(479, 3)<br>W(480, 3) | W(481, 3)<br>W(482, 3)<br>W(483, 3) | ····· | W(718, 3)<br>W(719, 3)<br>W(720, 3) | W(721, 3)<br>W(722, 3)<br>W(723, 3) | ····· | W(958, 3)<br>W(959, 3)<br>W(960, 3) |
| W(1, 4)<br>W(2, 4)<br>W(3, 4) | ····· | W(238, 4)<br>W(239, 4)<br>W(240, 4) | W(241, 4)<br>W(242, 4)<br>W(243, 4) | ····· | W(478, 4)<br>W(479, 4)<br>W(480, 4) | W(481, 4)<br>W(482, 4)<br>W(483, 4) | ····· | W(718, 4)<br>W(719, 4)<br>W(720, 4) | W(721, 4)<br>W(722, 4)<br>W(723, 4) | ····· | W(958, 4)<br>W(959, 4)<br>W(960, 4) |
| W(1, 5)<br>W(2, 5)<br>W(3, 5) | ····· | W(238, 5)<br>W(239, 5)<br>W(240, 5) | W(241, 5)<br>W(242, 5)<br>W(243, 5) | ····· | W(478, 5)<br>W(479, 5)<br>W(480, 5) | W(481, 5)<br>W(482, 5)<br>W(483, 5) | ····· | W(718, 5)<br>W(719, 5)<br>W(720, 5) | W(721, 5)<br>W(722, 5)<br>W(723, 5) | ····· | W(958, 5)<br>W(959, 5)<br>W(960, 5) |
| W(1, 6)<br>W(2, 6)<br>W(3, 6) | ····· | W(238, 6)<br>W(239, 6)<br>W(240, 6) | W(241, 6)<br>W(242, 6)<br>W(243, 6) | ····· | W(478, 6)<br>W(479, 6)<br>W(480, 6) | W(481, 6)<br>W(482, 6)<br>W(483, 6) | ····· | W(718, 6)<br>W(719, 6)<br>W(720, 6) | W(721, 6)<br>W(722, 6)<br>W(723, 6) | ····· | W(958, 6)<br>W(959, 6)<br>W(960, 6) |
| ⋮ | ····· | ⋮ | ⋮ | ····· | ⋮ | ⋮ | ····· | ⋮ | ⋮ | ····· | ⋮ |

Fig.18

480 PIXELS × 30 BITS

120 PIXELS × 30 BITS

ONE PIXEL

| | | | | | | | | | | | |
|---|---|---|---|---|---|---|---|---|---|---|---|
| W(1, 1)<br>W(2, 1)<br>0 | ····· | W(239, 1)<br>W(240, 1)<br>0 | W(241, 1)<br>W(242, 1)<br>0 | ····· | W(479, 1)<br>W(480, 1)<br>0 | W(481, 1)<br>W(482, 1)<br>0 | ····· | W(719, 1)<br>W(720, 1)<br>0 | W(721, 1)<br>W(722, 1)<br>0 | ····· | W(959, 1)<br>W(960, 1)<br>0 |
| W(1, 2)<br>W(2, 2)<br>0 | ····· | W(239, 2)<br>W(240, 2)<br>0 | W(241, 2)<br>W(242, 2)<br>0 | ····· | W(479, 2)<br>W(480, 2)<br>0 | W(481, 2)<br>W(482, 2)<br>0 | ····· | W(719, 2)<br>W(720, 2)<br>0 | W(721, 2)<br>W(722, 2)<br>0 | ····· | W(959, 2)<br>W(960, 2)<br>0 |
| W(1, 3)<br>W(2, 3)<br>0 | ····· | W(239, 3)<br>W(240, 3)<br>0 | W(241, 3)<br>W(242, 3)<br>0 | ····· | W(479, 3)<br>W(480, 3)<br>0 | W(481, 3)<br>W(482, 3)<br>0 | ····· | W(719, 3)<br>W(720, 3)<br>0 | W(721, 3)<br>W(722, 3)<br>0 | ····· | W(959, 3)<br>W(960, 3)<br>0 |
| W(1, 4)<br>W(2, 4)<br>0 | ····· | W(239, 4)<br>W(240, 4)<br>0 | W(241, 4)<br>W(242, 4)<br>0 | ····· | W(479, 4)<br>W(480, 4)<br>0 | W(481, 4)<br>W(482, 4)<br>0 | ····· | W(719, 4)<br>W(720, 4)<br>0 | W(721, 4)<br>W(722, 4)<br>0 | ····· | W(959, 4)<br>W(960, 4)<br>0 |
| W(1, 5)<br>W(2, 5)<br>0 | ····· | W(239, 5)<br>W(240, 5)<br>0 | W(241, 5)<br>W(242, 5)<br>0 | ····· | W(479, 5)<br>W(480, 5)<br>0 | W(481, 5)<br>W(482, 5)<br>0 | ····· | W(719, 5)<br>W(720, 5)<br>0 | W(721, 5)<br>W(722, 5)<br>0 | ····· | W(959, 5)<br>W(960, 5)<br>0 |
| W(1, 6)<br>W(2, 6)<br>0 | ····· | W(239, 6)<br>W(240, 6)<br>0 | W(241, 6)<br>W(242, 6)<br>0 | ····· | W(479, 6)<br>W(480, 6)<br>0 | W(481, 6)<br>W(482, 6)<br>0 | ····· | W(719, 6)<br>W(720, 6)<br>0 | W(721, 6)<br>W(722, 6)<br>0 | ····· | W(959, 6)<br>W(960, 6)<br>0 |
| ⋮ | ····· | ⋮ | ⋮ | ····· | ⋮ | ⋮ | ····· | ⋮ | ⋮ | ····· | ⋮ |

DISPLAY DEVICE AND METHOD FOR PROCESSING DATA IN DISPLAY DEVICE

TECHNICAL FIELD

The present invention relates to a display device, and more particularly to a display device such as a liquid crystal display device configured to perform color display by a field sequential system.

BACKGROUND ART

In general, in a liquid crystal display device configured to perform color display, one pixel is divided into three subpixels of a red pixel provided with a color filter that transmits red light, a green pixel provided with a color filter that transmits green light, and a blue pixel provided with a color filter that transmits blue light. While the color filters provided in these three subpixels enable the color display, about ⅔ of a backlight beam with which a liquid crystal panel is irradiated is absorbed in the color filters. This poses a problem that light utilization efficiency is low in the liquid crystal display device employing the color filter system. Consequently, attention has been focused on a liquid crystal display device employing a field sequential system configured to perform the color display without using the color filters.

In the liquid crystal display device employing the field sequential system, one frame period, which is a display period of one screen, is typically divided into three fields. While the field is also called a sub-frame, in the following description, the term of "field" is consistently used. For example, one frame period is divided into a field (a red field) configured to display a red screen based on a red component of an input image signal, a field (a green field) configured to display a green screen based on a green component of the input image signal, and a field (a blue field) configured to display a blue screen based on a blue component of the input image signal. The primary colors are displayed one by one as described above, by which a color image is displayed in a liquid crystal panel. Since the display of the color image is performed in this manner, the color filter is not required for the liquid crystal display device employing the field sequential system. Thus, the light utilization efficiency in the liquid crystal display device employing the field sequential system is about three times as high as that of the liquid crystal display device employing the color filter system. Accordingly, the liquid crystal display device employing the field sequential system is suitable for increase in luminance and decrease in power consumption.

In a general liquid crystal display device, the one frame period is 1/60 second. Accordingly, in the case where the one frame period is divided into three fields as described above, a length of each of the fields is 1/180 second. That is, a refresh rate indicating a speed of rewriting the whole screen displayed in the liquid crystal panel is 180 Hz.

In some cases, a signal processing circuit configured to apply signal processing to an input image signal, and a timing control circuit configured to control operation of a gate driver (a scanning signal line drive circuit), a source driver (a video signal line drive circuit) and the like are provided in different substrates. In such a configuration, in order to implement the refresh rate of 180 Hz, it is necessary that data transfer is performed at a frequency of 180 Hz between the substrates.

Moreover, as to the liquid crystal display device employing the field sequential system, conventionally, there has been known a problem that color breakup occurs. Consequently, in order to suppress the occurrence of the color breakup, the one frame period may be divided into four or five fields. In this case, in the one frame period, in addition to the red field, the green field, and the blue field, for example, a white field, a yellow field, and the like are provided. In a case where one frame period is divided into four fields, the refresh rate is 240 Hz. In the configuration where the signal processing circuit and the timing control circuit are provided indifferent substrates, the data transfer needs to be performed at a frequency of 240 Hz between the substrates. In a case where one frame period is divided into five fields, the refresh rate is 300 Hz. In the configuration where the signal processing circuit and the timing control circuit are provided in different substrates, the data transfer needs to be performed at a frequency of 300 Hz between the substrates.

As described above, when the field sequential system is employed, the data transfer between the substrates needs to be performed at a high frequency. As means for implementing the data transfer at the above-described high frequency, it can be considered to use a special interface. However, the use of the special interface increases costs. Consequently, in order to perform the data transfer at a high frequency, there has been proposed a technique of using a well-known standardized interface such as HDMI (registered trademark) (High-Definition Multimedia Interface), DVI (Digital Visual Interface) and the like. It should be noted that the DVI is a standard of a video output interface designed to make the most use of video quality of a digital display device. A standard resulting from adding various functions to the DVI is the HDMI.

It should be noted that, in relation to the present invention, the following prior art document has been known. Japanese Laid-Open Patent Publication No. 2001-331142 discloses an invention of an image display device in which a multi-gradation video signal is converted to a pulse width modulation signal for each bit of gradation data to drive a display element in a time-division manner for each bit. According to this image display device, since an existing pulse width modulation (PWM) circuit can be used, an increase in circuit scale can be suppressed.

PRIOR ART DOCUMENT

Patent Document

[Patent Document 1] Japanese Laid-Open Patent Publication No. 2001-331142

SUMMARY OF THE INVENTION

Problems to be Solved by the Invention

However, in order to transfer video data of, for example, FHD (Full High Definition) at a high frequency such as 300 Hz and the like, using the HDMI or DVI interface, a plurality of transmission paths (cables) are required. That is, the video data is transferred between the substrates, using the plurality of transmission paths. Accordingly, when the video data is transferred between the substrates, the relevant video data is beforehand divided depending on a number of transmission paths. Accordingly, a format of the video data for one field to be transferred by each of the transmission paths becomes, for example, 80 columns×1080 rows. In the case of this example, a size of the row may be too small to normally transfer the video data by the interface of the HDMI or DVI. In this manner, regarding the video data transferred in each of the transmission paths, the division of the video data beforehand may result in a format in which the video data cannot be transferred by the interface of the HDMI or the DVI. Moreover, in the invention disclosed in Japanese Laid-Open Patent Publication No. 2001-331142, data transfer among a plurality of substrates is not considered.

Therefore, an object of the present invention is to realize a display device employing a field sequential system that can transfer video data for field sequential among a plurality of substrates through a general standard interface (e.g., HDMI or DVI).

Means for Solving the Problems

A first aspect of the present invention is directed to a display device employing a field sequential system configured to perform color display by dividing one frame period into a plurality of fields and displaying a different in each color field, the display device including:

a display panel configured to display an image;

a first circuit substrate having a signal processing circuit configured to generate field data as data on a field basis by performing signal processing to an input image signal; and a second circuit substrate having a circuit configured to perform processing for causing the display panel to display an image based on the field data transmitted from the first circuit substrate, wherein the field data is transmitted from the first circuit substrate to the second circuit substrate through a plurality of cables having a standardized interface, and the signal processing circuit includes:

a signal separation circuit configured to separate the input image signal for one frame period into first intermediate data on a field basis;

a rearrangement circuit configured to generate the field data by converting the first intermediate data to second intermediate data having a format based on the standardized interface and by rearranging the second intermediate data so that data for a plurality of rows is simulatively put together as data for one row; and a field data output circuit configured to output the field data to the second circuit substrate at a frequency based on a number of fields configuring one frame period.

According to a second aspect of the present invention, in the first aspect of the present invention, a plurality of timing control circuits configured to control operation of a panel drive circuit that drives the display panel are mounted on the second circuit substrate, the timing control circuits being connected to the respective plurality of cables, and the plurality of timing control circuits return arrangement order of data included in field data outputted from the field data output circuit to arrangement order before the rearrangement by the rearrangement circuit is performed.

According to a third aspect of the present invention, in the first aspect of the present invention, the field data output circuit comprises:

a memory;

a writing circuit configured to write in the memory the field data generated by the rearrangement circuit; and a reading circuit configured to read field data written in the memory at a frequency based on a number of fields configuring one frame period, and to output the read field data to the second circuit substrate.

According to a fourth aspect of the present invention, in the first aspect of the present invention, the rearrangement circuit converts the first intermediate data to the second intermediate data including red, green, and blue data simulatively.

According to a fifth aspect of the present invention, in the first aspect of the present invention, when the data for the plurality of rows is simulatively put together as the data for one row by the rearrangement circuit, data of every n-th (n is a natural number) row is put together as data for one row.

According to a sixth aspect of the present invention, in the first aspect of the present invention, a number of fields configuring one frame period is four or more.

According to a seventh aspect of the present invention, in the first aspect of the present invention, the standardized interface is a high-definition multimedia interface.

According to an eighth aspect of the present invention, in the first aspect of the present invention, the standardized interface is a digital visual interface.

A ninth aspect of the present invention is directed to a method for processing data in a display device employing a field sequential system including a display panel configured to display an image, a first circuit substrate, and a second circuit substrate, the display device being configured to perform color display by dividing one frame period into a plurality of fields and displaying a different color in each field, the method comprising:

a signal processing step of generating field data as data on a field basis by performing signal processing to an input image signal in the first circuit substrate; and a display control step of performing, in the second circuit substrate, processing for causing the display panel to display an image based on the field data transmitted from the first circuit substrate, wherein the field data is transmitted from the first circuit substrate to the second circuit substrate through a plurality of cables having a standardized interface, and the signal processing step includes:

a signal separation step of separating the input image signal for one frame period into first intermediate data on a field basis;

a rearrangement step of generating the field data by converting the first intermediate data to second intermediate data having a format based on the standardized interface and by rearranging the second intermediate data so that data for a plurality of rows is simulatively put together as data for one row; and a field data output step of outputting the field data to the second circuit substrate at a frequency based on a number of fields configuring one frame period.

Effects of the Invention

According to the first aspect of the present invention, the input image signal for the one frame period is separated to the first intermediate data on the field basis as the data for field sequential by the signal separation circuit. The first intermediate data is converted to the second intermediate data depending on the standardized interface by the rearrangement circuit. Further, the processing of putting the data for the plurality of rows together as the data for one row is applied to the second intermediate data by the rearrangement circuit, by which the field data is generated. In this manner, the field data having a larger size of the column than a size of the column of the second intermediate data is generated. Thus, even when the field data divided depending on a number of transmission paths (a number of cables connecting the first circuit substrate having the signal processing circuit, and the second circuit substrate having the circuit configured to perform the processing for causing the display panel to display the image based on the field data) is transmitted from the first circuit substrate to the second circuit substrate, the size of the column of the field data to be transmitted does not become too small. Accordingly, the field data divided depending on the number of transmission paths is normally transferred to the second circuit substrate through the standardized interface. That is, the transfer of the field data between substrates at a high frequency can be performed, using the general interface easily available. As described above, the display device employing the field sequential system is realized, that can normally transfer the video data for field sequential among the plurality of substrates through the general standard interface.

According to the second aspect of the present invention, as for the display device employing the field sequential system, the configuration can be easily employed, in which the signal processing circuit and the timing control circuit are mounted on the different substrates.

According to the third aspect of the present invention, by holding the field data temporarily in the memory, the frequency conversion between the data input to the signal processing circuit and the data output from the signal processing circuit can be easily performed.

According to the fourth aspect of the present invention, the interface having the transmission paths for RGB can be effectively used.

According to the fifth aspect of the present invention, in a case where a plurality of scanning signal lines are driven at one time, processing for dividing the data into a plurality of pieces on a drive circuit side becomes unnecessary.

According to the sixth aspect of the present invention, when the one frame period is 1/60 second, the transfer of the video data for field sequential among the substrates can be performed at a frequency of 240 Hz or more, using the general interface easily available.

According to the seventh aspect of the present invention, the display device employing the field sequential system is realized, that can normally transfer the video data for field sequential among the plurality of substrates through the high-definition multimedia interface (HDMI).

According to the eighth aspect of the present invention, the display device employing the field sequential system is realized, that can normally transfer the video data for field sequential among the plurality of substrates through the digital visual interface (DVI).

According to the ninth aspect of the present invention, as in the first aspect of the present invention, the transfer of the video data for field sequential among the substrates can be performed at a high frequency, using the general interface easily available.

BRIEF DESCRIPTION OF THE DRAWINGS

FIG. 9 is a diagram for illustrating processing of the signal processing circuit in the first embodiment.

FIG. 12 is a diagram for illustrating the processing of the signal processing circuit in the first embodiment.

FIG. 18 is a diagram for illustrating the processing of the signal processing circuit in the second embodiment.

MODES FOR CARRYING OUT THE INVENTION

1. First Embodiment

<1.1 Whole Configuration and Operation Outline>

Figure 1:
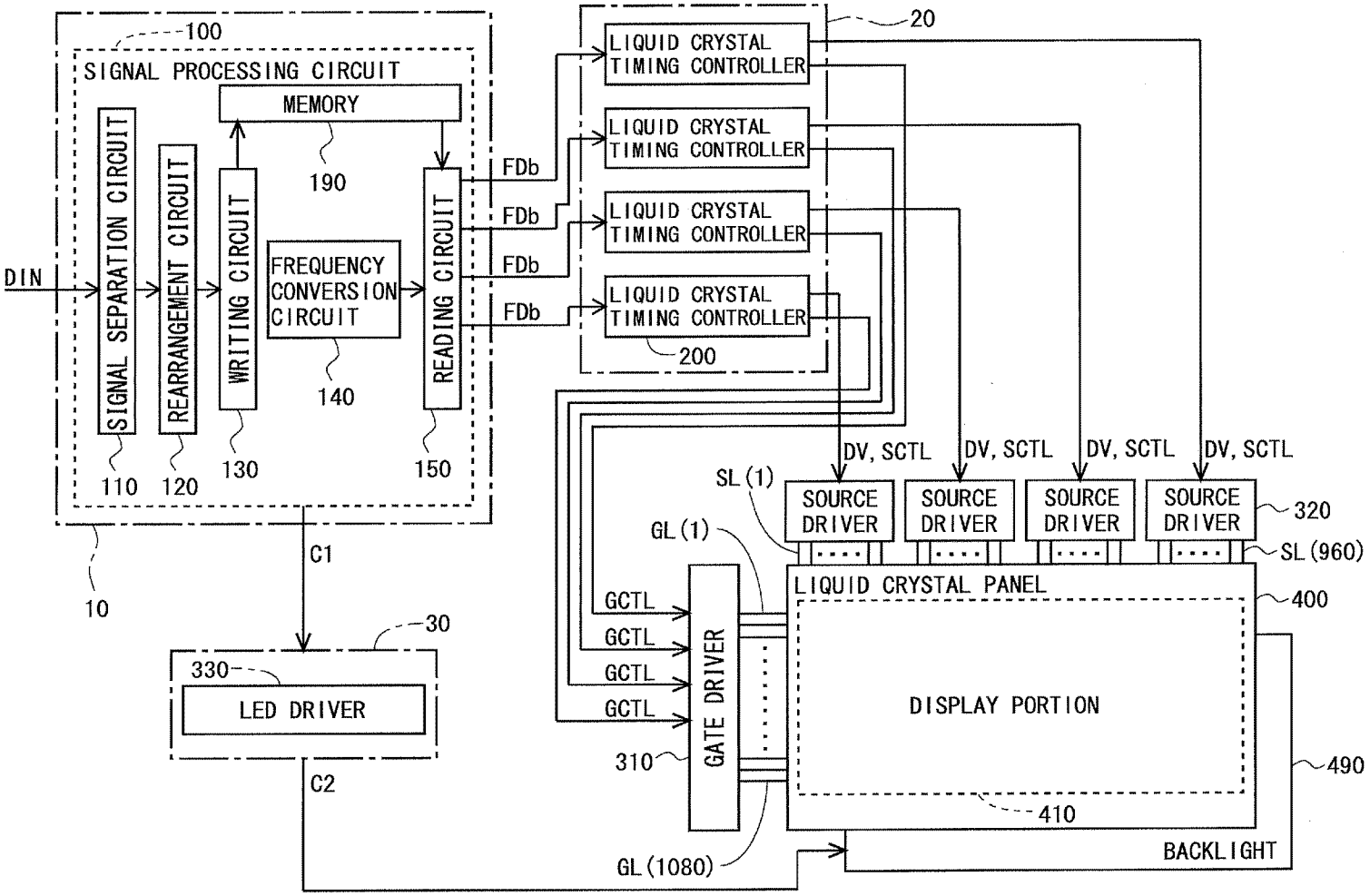
FIG. 1 is a block diagram showing a whole configuration of a liquid crystal display device according to a first embodiment of the present invention.

FIG. 1 is a block diagram showing a whole configuration of a liquid crystal display device according to a first embodiment of the present invention. This liquid crystal display device is configured by a signal processing circuit 100, liquid crystal timing controllers 200, a gate driver 310, source drivers 320, an LED driver 330, a liquid crystal panel 400, and a backlight 490. The liquid crystal panel 400 includes a display portion 410 for displaying an image. The signal processing circuit 100 includes a signal separation circuit 110, a rearrangement circuit 120, a writing circuit 130, a frequency conversion circuit 140, a reading circuit 150, and a memory 190. For a light source of the backlight 490, LEDs (Light-Emitting Diodes) are employed. Specifically, the backlight 490 is configured by red LEDs, green LEDs, and blue LEDs.

It should be noted that, in the present embodiment, a panel drive circuit is implemented by the gate driver 310, the source drivers 320, and the LED driver 330, and a timing control circuit is implemented by the liquid crystal timing controllers 200.

The signal processing circuit 100 is mounted on a first circuit substrate 10, and the liquid crystal timing controllers 200 are mounted on a second circuit substrate 20. That is, the signal processing circuit 100 and the liquid crystal timing controllers 200 are provided in the different substrates. The LED driver 330 is mounted on a third circuit substrate 30. The liquid crystal panel 400 is configured by two glass substrates. The gate driver 310 and the source drivers 320 are mounted around a glass substrate or on a glass substrate.

In the present embodiment, the data transfer between the first circuit substrate 10 and the second circuit substrate 20 is performed through an interface conforming to an HDMI standard. Specifically, the signal processing circuit 100 mounted on the first circuit substrate 10, and the liquid crystal timing controllers 200 mounted on the second circuit substrate 20 are connected to each other through HDMI cables. As understood from FIG. 1, in the present embodiment, the liquid crystal display device is provided with the four liquid crystal timing controllers 200. Each of those four liquid crystal timing controllers 200 and the signal processing circuit 100 are connected by the HDMI cable. That is, the data transfer between the first circuit substrate 10 and the second circuit substrate 20 is performed by use of the four HDMI cables.

Figure 2:
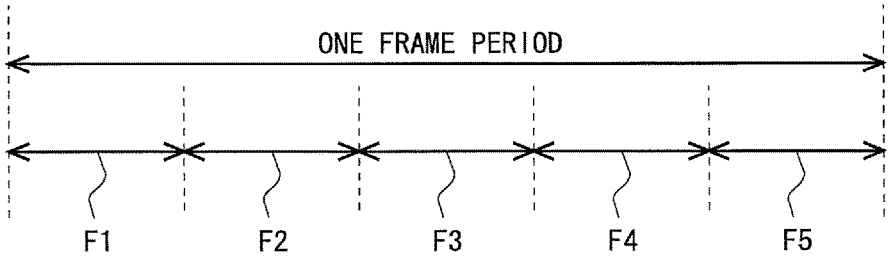
FIG. 2 is a diagram showing a configuration of one frame period in the first embodiment.
Figure 3:
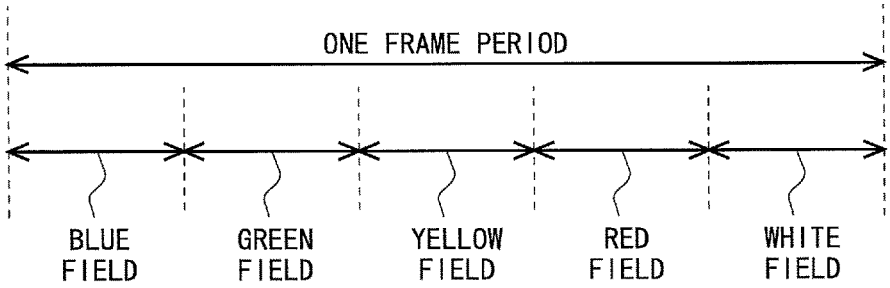
FIG. 3 is a diagram showing a specific configuration example of the one frame period in the first embodiment.

FIG. 2 is a diagram showing a configuration of one frame period in the present embodiment. As shown in FIG. 2, in the present embodiment, the one frame period is configured by five fields F1 to F5. For example, one frame period is configured by a blue field, a green field, a yellow field, a red field, and a white field, as shown in FIG. 3. In a case shown in FIG. 3, an LED lighted in each of the fields is as follows. In the blue field, only blue LEDs are lighted. In the green field, only green LEDs are lighted. In the yellow field, the green LEDs and red LEDs are lighted. In the red field, only the red LEDs are lighted. In the white field, the LEDs in all the colors (red, green, and blue) are lighted. In this manner, in the present embodiment, the color display is performed by the field sequential system in which the one frame period is divided into the five fields. It should be noted that the provision of the white field and the yellow field as shown in FIG. 3 can suppress occurrence of color breakup.

In the following description, a length of the one frame period is assumed to be 1/60 second. Since one frame period is configured by the five fields F1 to F5, a length of the one field is 1/300 second. Moreover, it is assumed that an input image signal DIN externally inputted in this liquid crystal display device includes a red component (a red gradation value), a green component (a green gradation value), and a blue component (a blue gradation value), and that each of the red component, the green component, and the blue component is data of 10 bits.

Regarding FIG. 1, in the display portion 410, 960 source bus lines (video signal lines) SL(1) to SL(960), and 1080 gate bus lines (scanning signal lines) GL(1) to GL(1080) are arranged. A pixel formation portion (not shown in FIG. 1) configured to forma pixel is provided in correspondence with an intersection between each of the source bus lines SL(1) to SL(960) and each of the gate bus lines GL(1) to GL(1080). That is, the display portion 410 includes (960×1080) pixel formation portions.

Figure 4:
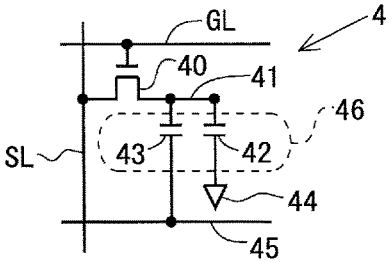
FIG. 4 is a diagram showing a configuration of a pixel formation portion in the first embodiment.

FIG. 4 is a diagram showing a configuration of a pixel formation portion 4. As shown in FIG. 4, the pixel formation portion 4 includes a TFT (Thin Film Transistor) 40 as a switching element having a gate terminal that is connected to the gate bus line GL passing the corresponding intersection and a source terminal that is connected to the source bus line SL passing the relevant intersection, a pixel electrode 41 connected to a drain terminal of the TFT 40, a common electrode 44 and an auxiliary capacitance electrode 45 provided in common to the above-described plurality of pixel formation portions 4, a liquid crystal capacitance 42 formed of the pixel electrode 41 and the common electrode 44, and an auxiliary capacitance 43 formed of the pixel electrode 41 and the auxiliary capacitance electrode 45. A pixel capacitance 46 is configured by the liquid crystal capacitance 42 and the auxiliary capacitance 43.

Next, operation of configuration elements shown in FIG. 1 will be described. The signal processing circuit 100 performs signal processing to the input image signal DIN supplied externally, to output field data FDb as video data for each field, and an LED driver control signal C1 for controlling operation of the LED driver 330. It should be noted that a detailed description of the respective configuration elements inside the signal processing circuit 100 will be described later.

The liquid crystal timing controllers 200 each output a digital video signal DV, a gate control signal GCTL for controlling operation of the gate driver 310, and a source control signal SCTL for controlling operation of the source drivers 320, based on the field data FDb sent from the signal processing circuit 100. The gate control signal GCTL includes, for example, a gate start pulse signal and a gate clock signal. The source control signal SCTL includes, for example, a source start pulse signal, a source clock signal, and a latch strobe signal.

Figure 5:
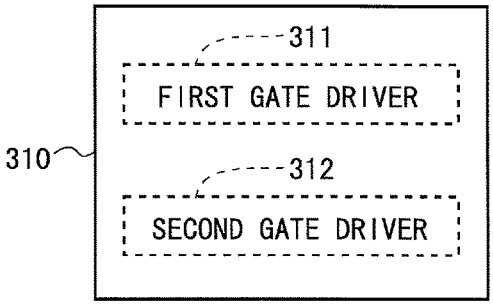
FIG. 5 is a block diagram showing an internal configuration of a gate driver in the first embodiment.
Figure 6:
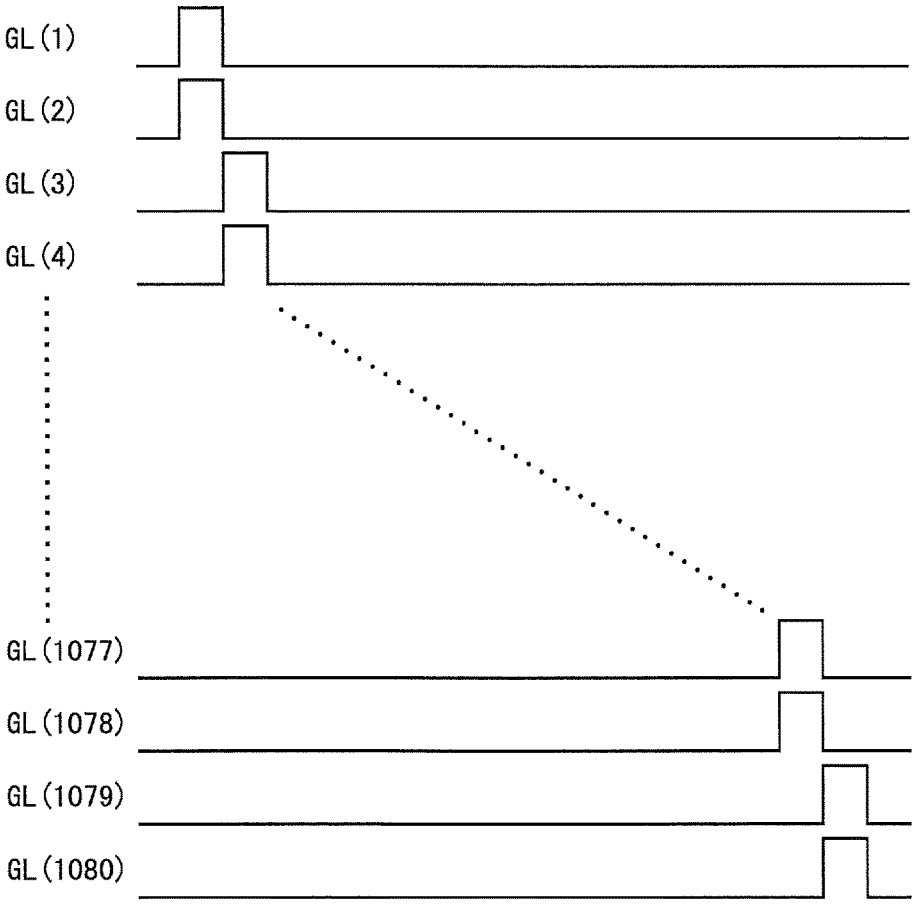
FIG. 6 is a timing chart for illustrating drive of gate bus lines in the first embodiment.

The gate driver 310 repeats application of an active scanning signal to each of the gate bus lines GL with one vertical scanning period being as a cycle, based on a gate control signal GCTL sent from each of the liquid crystal timing controllers 200. It should be noted that the gate driver 310 in the present embodiment is internally divided into a first gate driver 311 configured to drive the gate bus lines in odd-numbered rows, and a second gate driver 312 configured to drive the gate bus lines in even-numbered rows, as shown in FIG. 5. In such a configuration, as shown in FIG. 6, two gate bus lines are driven at one time. It should be noted that the present invention can be applied to a case where one gate bus line is driven at one time as in a general liquid crystal display device.

Figure 7:
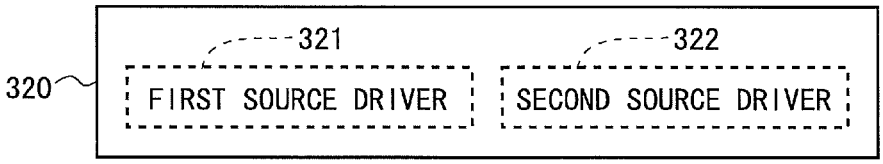
FIG. 7 is a block diagram showing an internal configuration of a source driver in the first embodiment.

The source drivers 320 each receive the digital video signal DV and the source control signal SCTL which are sent from the relevant liquid crystal timing controller 200, to apply a video signal for drive to each of the source bus lines SL. At this time, in each of the source drivers 320, the digital video signal DV indicating a voltage to be applied to each of the source bus lines SL is sequentially held at timing when a pulse of the source clock signal occurs. At timing when a pulse of the latch strobe signal occurs, the above-described held digital video signal DV is converted to an analog voltage. This converted analog voltage is simultaneously applied to all the source bus lines SL(1) to SL(960) as the video signal for drive. As understood from FIG. 1, in the present embodiment, the liquid crystal display device is provided with the four source drivers 320. Each of those four source drivers 320 is internally divided into a first source driver 321 configured to output the video signal for drive for the odd-numbered rows, and a second source driver 322 configured to output the video signal for drive for even-numbered rows, as shown in FIG. 7.

The LED driver 330 outputs a light source control signal C2 for controlling a state of each of the LEDs configuring the backlight 490, on the basis of the LED driver control signal C1 sent from the signal processing circuit 100. In the backlight 490, switching of the state of each of the LEDs (switching between a lighting state and a lights-off state) is appropriately performed on the basis of the light source control signal C2.

As described above, the scanning signals are applied to the gate bus lines GL(1) to GL(1080), the video signals for drive are applied to the source bus lines SL(1) to SL(960), and the state of each of the LEDs is switched appropriately. Thereby, the color image based on the input image signal DIN is displayed in the display portion 410 of the liquid crystal panel 400.

<1.2 Signal Processing Circuit>

Figure 8:
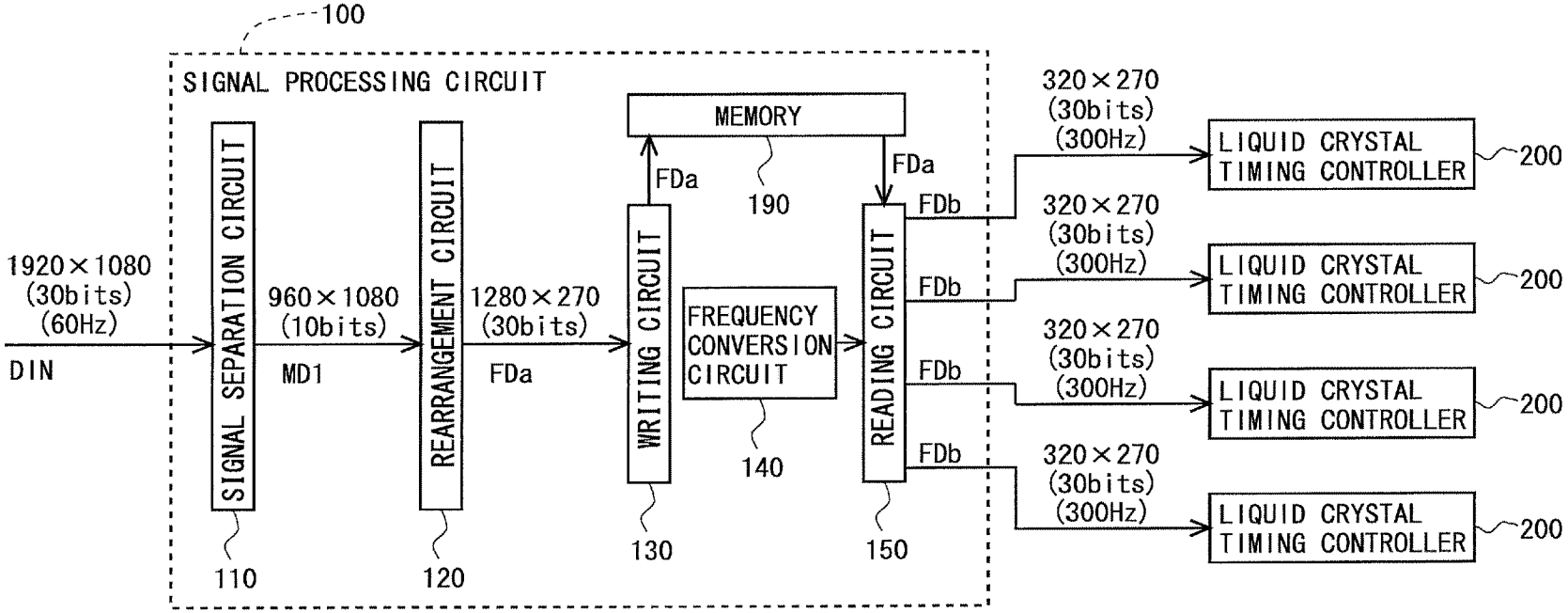
FIG. 8 is a block diagram for illustrating details of a signal processing circuit in the first embodiment.

Next, referring to FIG. 8, respective configuration elements included in the signal processing circuit 100 will be described in detail. As shown in FIG. 8, the signal processing circuit 100 includes the signal separation circuit 110, the rearrangement circuit 120, the writing circuit 130, the frequency conversion circuit 140, the reading circuit 150, and the memory 190. In the present embodiment, a field data output circuit is implemented by the writing circuit 130, the reading circuit 150, and the memory 190. It should be noted that, in FIG. 8, field data generated in the rearrangement circuit 120 is given reference character FDa, and field data outputted from the reading circuit 150 is given reference character FDb (these are similarly applied to FIGS. 16, 21, and 23). Moreover, in the following description, in the case where the field data FDa and the field data FDb are not particularly distinguished, the field data is given reference character FD. When the data is denoted by "I×J×K bits" (I, J, and K are numerical values), I denotes a size of a column of the data, J denotes a size of a row of the data, and K denotes a bit number of the data for one pixel.

Here, regarding the data for each of the fields, the data for each pixel is represented by W(i, j), as shown in FIG. 9, where "i" denotes a column, "j" denotes a row. For example, the data for a pixel in the 3rd column and the 1079th row is represented by W(3, 1079). It should be noted that the data for one pixel shown in FIG. 9 is 10 bits.

The signal separation circuit 110 separates the input image signal DIN sent externally into the data for the five fields (the fields F1 to F5) configuring one frame period. In a case where one frame period is configured as shown in FIG. 3, display gradation values of the five display colors (red, green, blue, yellow, and white) are calculated from the red gradation value, the green gradation value, and the blue gradation value included in the input image signal DIN. This calculation method is well-known, and the display gradation values of the five display colors are generated from the gradation values of the three primary colors on the basis of predetermined color distribution algorism. This color distribution algorism may be any well-known algorism.

As described above, the signal separation circuit 110 separates the input image signal DIN into the data for each of the fields. It should be noted that the data after separation is referred to as "first intermediate data" for convenience. The first intermediate data is given reference character MD1.

In the present embodiment, while the data of FHD is to be inputted at a frequency of 60 Hz as the input image signal DIN, processing for separating half of the data into the data for the five fields is performed in the signal separation circuit 110. Since the input image signal DIN for the one frame is 1920×1080×30 bits, the first intermediate data MD1 for one field generated by this signal separation circuit 110 is 960×1080×10 bits. Accordingly, the first intermediate data MD1 is schematically represented in FIG. 9.

Figure 10:
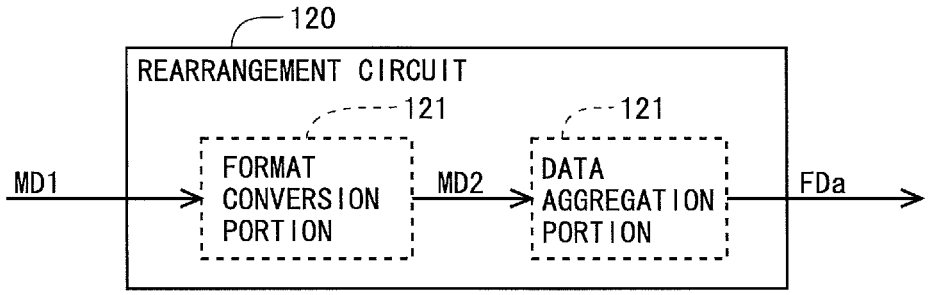
FIG. 10 is a block diagram showing a functional configuration of a rearrangement circuit in the first embodiment.

FIG. 10 is a block diagram showing a functional configuration of the rearrangement circuit 120. As shown in FIG. 10, the rearrangement circuit 120 includes a format conversion portion 121 and a data aggregation portion 122.

Figure 11:
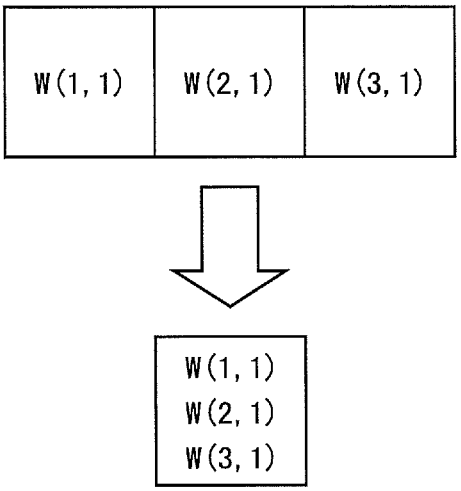
FIG. 11 is a diagram for illustrating the processing of the signal processing circuit in the first embodiment.

In the rearrangement circuit 120, first, the format conversion portion 121 converts the first intermediate data MD1 generated by the signal separation circuit 110 to data having a format conforming to the HDMI standard. It should be noted that this data after the conversion by the format conversion portion 121 is referred to as "second intermediate data" for convenience. The second intermediate data is given reference character MD2. For example, in HDMI1.3, 30 bits, 36 bits, and 48 bits are defined as color depth. Here, the color depth is assumed to be 30 bits. As to these 30 bits, 10 bits correspond to the red data, other 10 bits correspond to the green data, and the remaining 10 bits correspond to the blue data. In the present embodiment, for example, when the data for pixels in the first column and the first row to the third column and the first row are paid attention to, the data W(1, 1) for the pixel in the first column and the first row is simulatively treated as the red data, and the data W(2, 1) for the pixel in the second column and the first row is simulatively treated as the green data, and the data W(3, 1) for the pixel in the third column and the first row is simulatively treated as the blue data. In this manner, the data for the three pixels arranged continuously in a direction where each of the gate bus lines GL extends is treated as one collective piece of data (refer to FIG. 11). From the foregoing, the format conversion portion 121 in the rearrangement circuit 120 converts the first intermediate data MD1 of 960×1080×10 bits to the second intermediate data MD2 of 320×1080×30 bits. The second intermediate data MD2 is schematically represented as shown in FIG. 12. The data for one pixel in FIG. 12 is 30 bits.

As described above, in the liquid crystal display device according to the present embodiment, the four liquid crystal timing controllers 200 are provided. Accordingly, the field data FD generated in the signal processing circuit 100 is divided into four systems to be transmitted to the liquid crystal timing controllers 200. If the second intermediate data MD2 of 320×1080×30 bits is divided into the four systems for transmission, the field data FDb for one system is 80×1080×30 bits. However, in the case of a format of "80×1080", since the size of the column is small, data transfer using the HDMI cable is not normally performed in some cases. Consequently, the data aggregation portion 122 in the rearrangement circuit 120 rearranges the second intermediate data MD2, lest the size of the column of the field data FDb to be transmitted from the signal processing circuit 100 to each of the liquid crystal timing controllers 200 should be too small. This rearrangement generates the field data FDa.

Here, referring to FIGS. 12 to 14, the rearrangement of the second intermediate data MD2 will be described in detail. As described above, the second intermediate data MD2 is schematically represented as shown in FIG. 12. As understood from FIG. 12, as to the second intermediate data MD2, the size of the column is 320. If the second intermediate data MD2 like this is divided into the four systems for transmission, the size of the column with respect to data for one system is 80. That is, the size of the column with respect to the field data FDb outputted from the reading circuit 150 in the signal processing circuit 100 is ¼ of the size of the column with respect to the second intermediate data MD2. Consequently, in the present embodiment, the size of the column with respect to the data supplied to the reading circuit 150 (the field data FDa) is beforehand set to four times the size of the column with respect to the second intermediate data MD2, by which the size of the column with respect to the field data FDb outputted from the reading circuit 150 and the size of the column with respect to the second intermediate data MD2 are made the same. Moreover, as described above, in the present embodiment, the gate driver 310 drives the two gate bus lines GL at one time. From the foregoing, the data aggregation portion 122 in the rearrangement circuit 120 performs processing for putting the data for eight rows together as the data for two rows.

Figure 13:
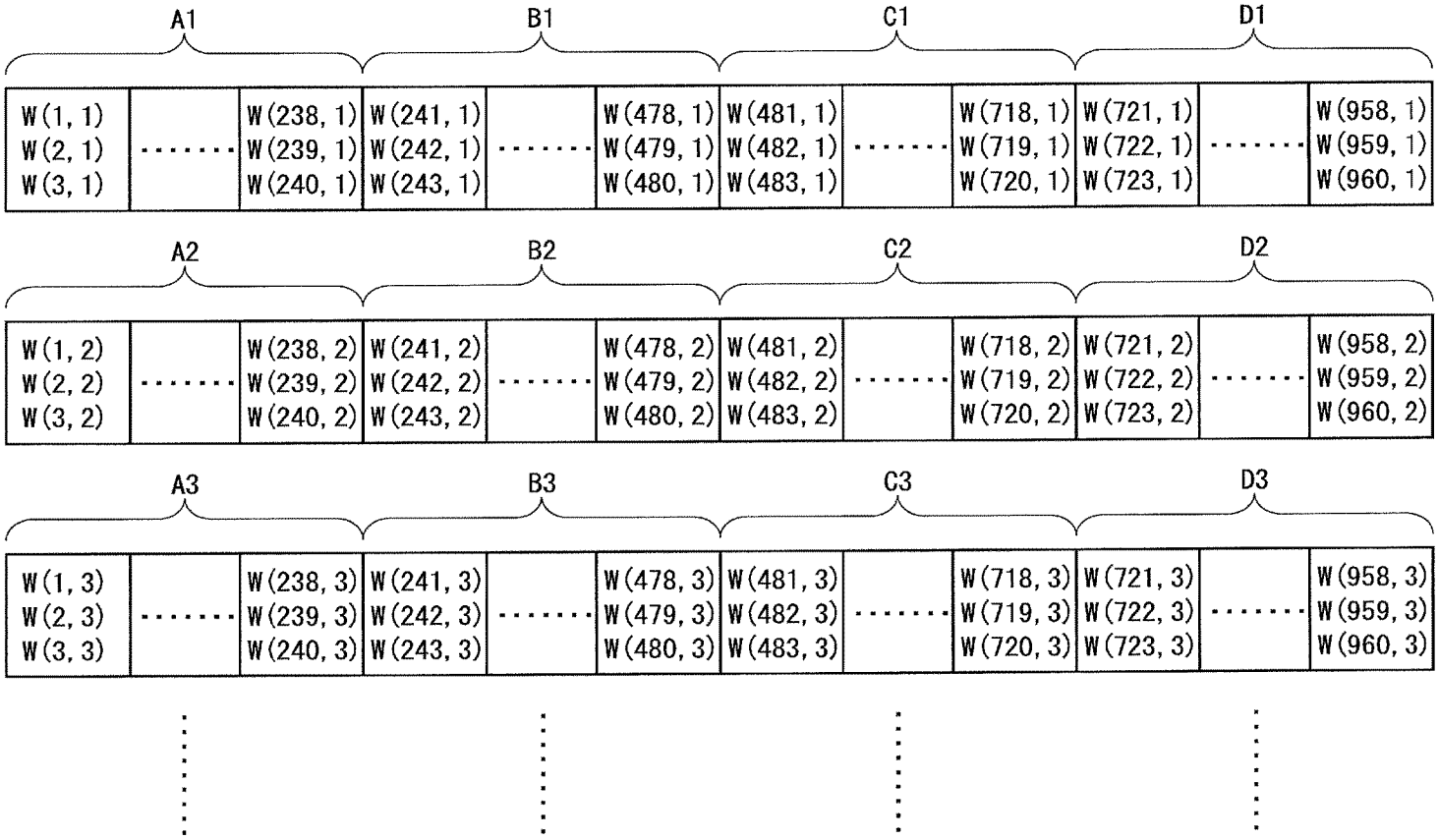
FIG. 13 is a diagram for illustrating the processing of the signal processing circuit in the first embodiment.

Regarding the data as represented in FIG. 12, the data of every 80 pixels are represented by "A1", "B1", "C1", "D1", "A2" or the like for convenience, as shown in FIG. 13. For example, the pixel data (W(1, 2), W(2, 2), W(3, 2)) for the first column and the second row in FIG. 12 to the pixel data (W(238, 2), W(239, 2), W(240, 2)) for the eightieth column and the second row in FIG. 12 is represented by "A2". The data represented by "Ak" (k is an integer of 1 or more and 1080 or less) is data to be transmitted to the liquid crystal timing controller 200 that controls operation of the source driver 320 for driving the source bus lines SL(1) to SL(240). The data represented by "Bk" is data to be transmitted to the liquid crystal timing controller 200 that controls operation of the source driver 320 for driving the source bus lines SL(241) to SL(480). The data represented by "Ck" is data to be transmitted to the liquid crystal timing controller 200 that controls operation of the source driver 320 for driving the source bus lines SL(481) to SL(720). The data represented by "Dk" is data to be transmitted to the liquid crystal timing controller 200 that controls operation of the source driver 320 for driving the source bus lines SL(721) to SL(960).

Figure 14:
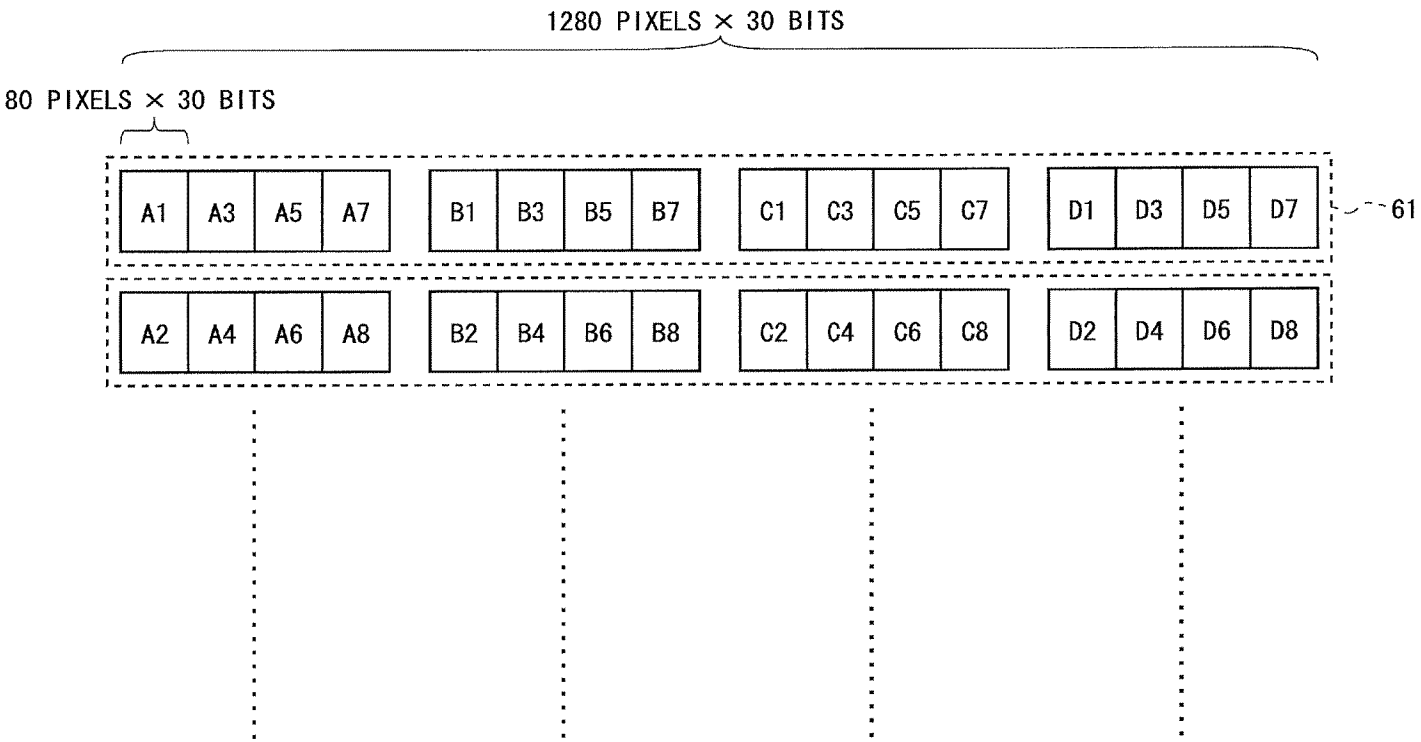
FIG. 14 is a diagram for illustrating the processing of the signal processing circuit in the first embodiment.

In the present embodiment, as shown in FIG. 14, the data for four rows on every other row is put together as data for one row. For example, the data denoted by reference character 61 in FIG. 14 is data obtained by putting the data in the 1st, 3rd, 5th, and 7th rows together as one row. It should be noted that, since the data for four rows on every other row is put together as the data for one row in this manner, in conclusion, the data for eight rows is put together as the data for two rows, as described above. The data represented by "A1" or the like in FIG. 14 is data of 80×30 bits. Moreover, since the data for four rows is put together as the data for one row, the size of the row with respect to the data after the rearrangement becomes ¼ of the size of the row with respect to the data before the rearrangement. Accordingly, the rearrangement is applied to the second intermediate data MD2 of 320×1080×30 bits by the data aggregation portion 122 in the rearrangement circuit 120, by which the field data FDa of 1280×270×30 bits is generated.

It should be noted that, although the two gate bus lines GL are driven atone time in the present embodiment, processing for dividing the data sent from the liquid crystal timing controller 200 into two in the source driver 320 becomes unnecessary by putting the data on every other row together.

The writing circuit 130 writes, in the memory 190, the field data FDa generated by the rearrangement circuit 120. Since the input image signal DIN for one frame is separated into the data for the five fields in the signal separation circuit 110 as described above, every time the input image signal DIN for one frame is inputted, five pieces of field data FDa are written in the memory 190, each field data FDa being 1280×270×30 bits.

The frequency conversion circuit 140 controls operation of the reading circuit 150 so that reading of the data (the field data FDa) from the memory 190 by the reading circuit 150 is performed at a high speed. Since the length of one field is 1/300 second as described above, the frequency conversion circuit 140 controls the operation of the reading circuit 150 so that the reading of the data by the reading circuit 150 is performed at 300 Hz.

The reading circuit 150 reads the field data FDa written in the memory 190 at the frequency of 300 Hz. Then, the reading circuit 150 divides the read field data FDa into four. Further, the reading circuit 150 transmits the four pieces of field data FDb after the division to the respective corresponding liquid crystal timing controllers 200. Since the data read from the memory 190 is divided into the four systems to be outputted in this manner, the data for one field per one system is 320×270×30 bits. That is, in each of the HDMI cables connecting the first circuit substrate 10, which has the signal processing circuit 100, and the second circuit substrate 20, which has the liquid crystal timing controllers 200, the data (the field data FDb) of 320×270×30 bits is transmitted per field.

The data in the state after the rearrangement by the rearrangement circuit 120 is performed is sent to the liquid crystal timing controllers 200. Thus, each of the liquid crystal timing controllers 200 performs processing for returning arrangement order of the data included in the received field data FDb to arrangement order before the rearrangement by the rearrangement circuit 120 is performed.

<1.3 Processing Procedure of Signal Processing Circuit>

Figure 15:
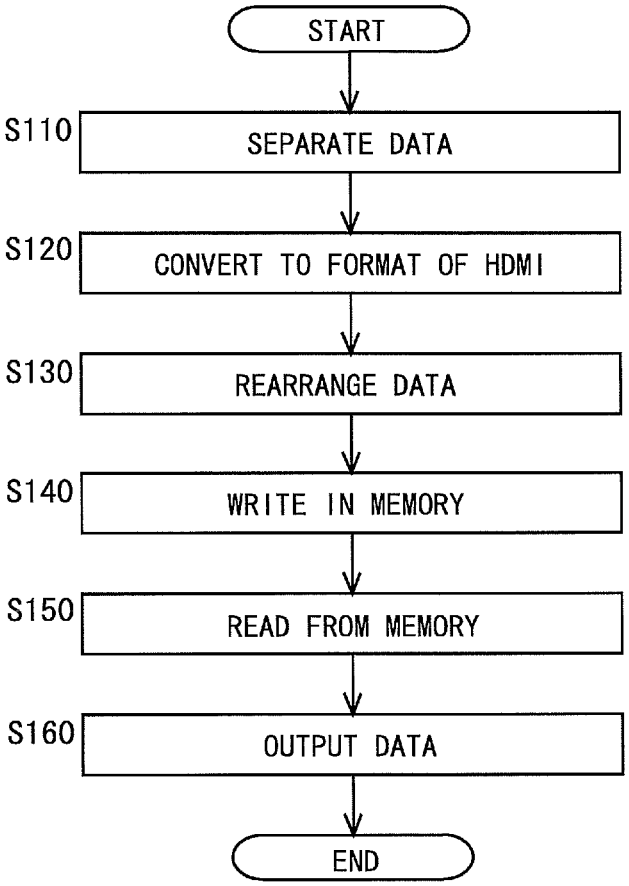
FIG. 15 is a flowchart for illustrating a processing procedure of the signal processing circuit in the first embodiment.

Referring to FIG. 15, a flow of the processing performed in the signal processing circuit 100 will be described. When the input image signal DIN (for one frame) is inputted to this signal processing circuit 100, the input image signal DIN is separated into the data for five fields by the signal separation circuit 110 (step S110). This step S110 allows the first intermediate data MD1 for five fields per one frame to be generated.

Next, the format conversion portion 121 in the rearrangement circuit 120 converts the first intermediate data MD1 to the data having the format conforming to the HDMI standard (step S120). This step S120 allows the second intermediate data MD2 to be generated.

Next, the data aggregation portion 122 in the rearrangement circuit 120 performs the rearrangement of the second intermediate data MD2 so that the data for a plurality of rows is simulatively put together as data for one row (step S130). This step S130 allows the field data FDa to be generated.

Next, the field data FDa generated in the rearrangement circuit 120 is written in the memory 190 by the writing circuit 130 (step S140). Thereafter, the field data FDa written in the memory 190 is read by the reading circuit 150 (step S150). Finally, the field data FDa read from the memory 190 is divided, and the field data FDb after the division is outputted to the liquid crystal timing controllers 200 (S160).

<1.4 Effect>

According to the present embodiment, in the signal processing circuit 100, after the input image signal DIN for one frame period is separated into the first intermediate data MD1 on the field basis, which is data for the field sequential, the first intermediate data MD1 is converted to the second intermediate data MD2 including the red, green and blue data simulatively so as to correspond to the HDMI standard. Furthermore, in the signal processing circuit 100, the field data FD is generated by putting the data for four rows on every other row together as the data for one row with respect to the second intermediate data MD2. In this manner, the field data FD having the larger size of the column than the size of the column of the second intermediate data MD2 is generated. Thus, even when the field data FD divided depending on the number of transmission paths (the number of HDMI cables connecting the first circuit substrate 10 having the signal processing circuit 100, and the second circuit substrate 20 having the liquid crystal timing controllers 200) is transmitted to the liquid crystal timing controllers 200, the size of the column of the field data FD to be transmitted does not become too small. Accordingly, the field data FD divided depending on the number of transmission paths is normally transferred to the liquid crystal timing controllers 200 through the interface of the HDMI standard. That is, the transfer of the field data FD between the substrates at the high frequency can be performed through the use of the interface of the HDMI standard easily available. In other words, as for the display device employing the field sequential system, the configuration can be easily employed, in which the signal processing circuit 100 and the liquid crystal timing controllers 200 are mounted on the different substrates. As described above, according to the present embodiment, the display device employing the field sequential system can be realized, that can normally transfer the field data (the video data for field sequential) FD among a plurality of substrates through the interface of the HDMI standard.

2. Second Embodiment

<2.1 Whole Configuration and Operation Outline>

A second embodiment of the present invention will be described. Since a whole configuration and an operation outline are similar to the first embodiment, description thereof will be omitted.

<2.2 Signal Processing Circuit>

Figure 16:
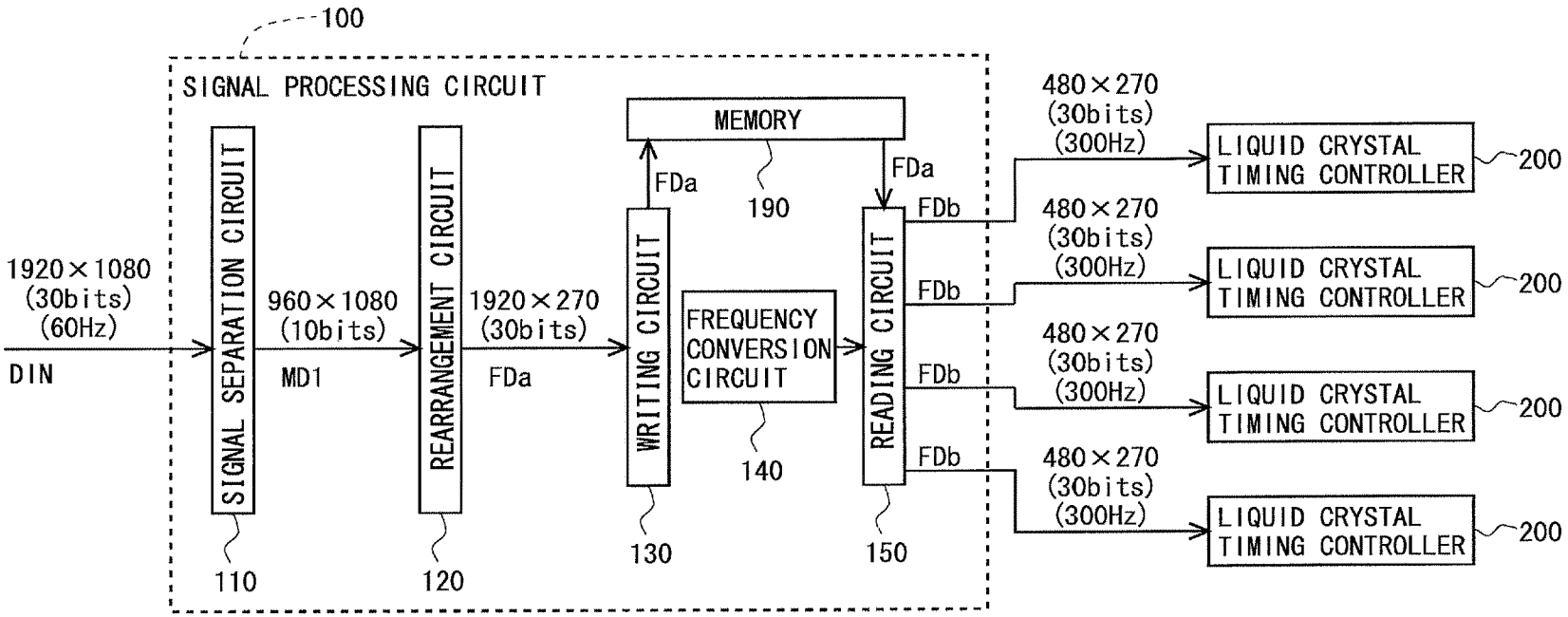
FIG. 16 is a block diagram for illustrating details of a signal processing circuit in a second embodiment of the present invention.

FIG. 16 is a block diagram for illustrating details of a signal processing circuit in the second embodiment of the present invention. As to points similar to the first embodiment, description thereof will be omitted in some cases.

The signal separation circuit 110 generates first intermediate data MD1 of 960×1080×10 bits as schematically represented in FIG. 9 by separating an input image signal DIN into data for five fields as in the first embodiment. It should be noted that the first intermediate data MD1 for five fields is generated per one frame.

Figure 17:
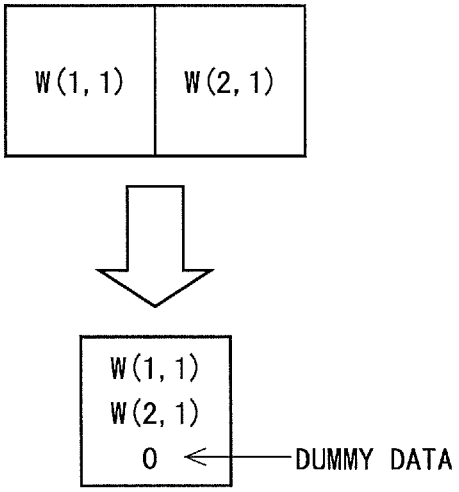
FIG. 17 is a diagram for illustrating processing of the signal processing circuit in the second embodiment.

A format conversion portion 121 in the rearrangement circuit 120 converts the first intermediate data MD1 generated by the signal separation circuit 110 to data having a format conforming to an HDMI standard. Thus, second intermediate data MD2 is generated. In the present embodiment, for example, when data for pixels in a first column and a first row to a second column and the first row is paid attention to, data W(1, 1) for the pixel in the first column and the first row is simulatively treated as red data, data W(2, 1) for the pixel in a second column and the first row is simulatively treated as green data. Moreover, in the present embodiment, dummy data simulatively treated as blue data is added. In this manner, the data for the two pixels arranged continuously in a direction where gate bus lines GL extend and the one dummy data are treated as one collective piece of data (refer to FIG. 17). From the foregoing, the format conversion portion 121 in the rearrangement circuit 120 converts the first intermediate data MD1 of 960×1080×10 bits to the second intermediate data MD2 of 480×1080×30 bits. The second intermediate data MD2 is schematically represented in FIG. 18. Data for one pixel in FIG. 18 is 30 bits. However, since the data of 10 bits out of these 30 bits is dummy data, it does not contribute to the image display. It should be noted that a reason for providing the dummy data in this manner is to set a size of field data FDb (the field data after division) that is transmitted to liquid crystal timing controllers 200 from the signal processing circuit 100 to a size that allows normal data transfer through an interface of the HDMI standard to be performed.

A data aggregation portion 122 in the rearrangement circuit 120 performs rearrangement of the second intermediate data MD2, lest a size of a column of the field data FDb to be transmitted from the signal processing circuit 100 to each of the liquid crystal timing controllers 200 should be too small. This rearrangement generates field data FDa.

Here, referring to FIGS. 18 to 20, the rearrangement of the second intermediate data MD2 will be described in detail. As described above, the second intermediate data MD2 is schematically represented as shown in FIG. 18. As understood from FIG. 18, as to the second intermediate data MD2, the size of the column is 480. If the second intermediate data MD2 is divided into four systems for transmission, the size of the column with respect to data for one system is 120. Consequently, as in the first embodiment, the size of the column with respect to the data supplied to the reading circuit 150 (the field data FDa) is beforehand set to four times the size of the column with respect to the second intermediate data MD2, by which the size of the column with respect to the field data FDb outputted from the reading circuit 150 and the size of the column with respect to the second intermediate data MD2 are made the same. Moreover, in the present embodiment as well, the gate driver 310 drives the two gate bus lines GL at one time. From the foregoing, the data aggregation portion 122 in the rearrangement circuit 120 performs processing for putting the data for eight rows together as the data for two rows.

Figure 19:
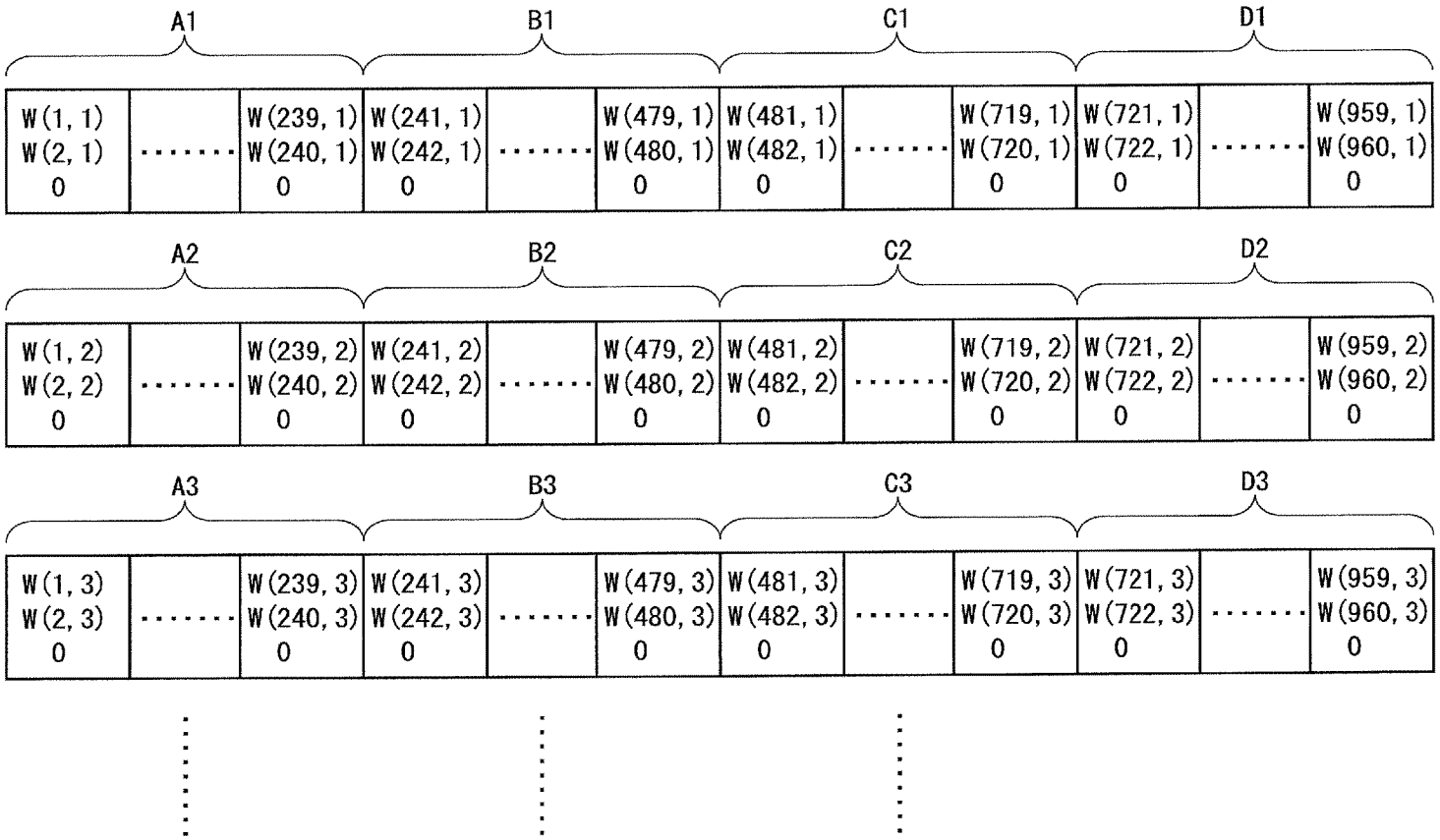
FIG. 19 is a diagram for illustrating the processing of the signal processing circuit in the second embodiment.
Figure 20:
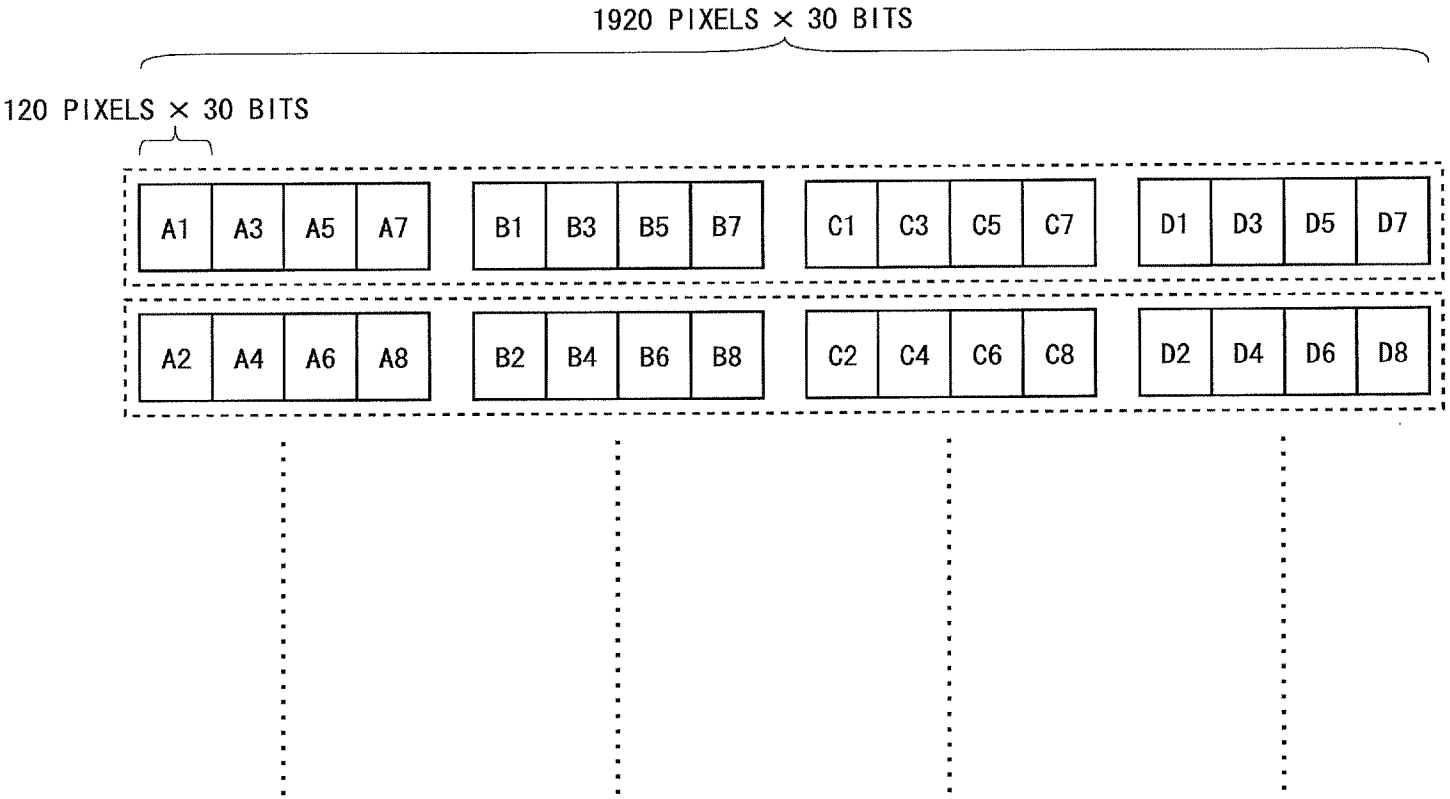
FIG. 20 is a diagram for illustrating the processing of the signal processing circuit in the second embodiment.

Regarding the data as represented in FIG. 18, the data of every 120 pixels are represented by "A1", "B1", "C1", "D1", "A2" or the like for convenience, as shown in FIG. 19. In the present embodiment, as shown in FIG. 20, the data for four rows on every other row is put together as data for one row. Since the data for four rows on every other row is put together as the data for one row in this manner, in conclusion, the data for eight rows is put together as the data for two rows, as described above. The data represented by "A1" and the like in FIG. 20 is data of 120×30 bits. Moreover, since the data for four rows is put together as the data for one row, the size of the row with respect to the data after the rearrangement becomes ¼ of the size of the row with respect to the data before the rearrangement. Accordingly, the rearrangement is applied to the second intermediate data MD2 of 480×1080×30 bits by the data aggregation portion 122 in the rearrangement circuit 120, by which the field data FDa of 1920×270×30 bits is generated.

The writing circuit 130 writes, in the memory 190, the field data FDa generated by the rearrangement circuit 120. Accordingly, every time the input image signal DIN for one frame is inputted, five pieces of field data FDa are written in the memory 190, each field data FDa being 1920×270×30 bits. A frequency conversion circuit 140 controls the operation of the reading circuit 150 so that the reading of the data by the reading circuit 150 is performed at 300 Hz.

The reading circuit 150 reads the field data FDa written in the memory 190 at the frequency of 300 Hz. The reading circuit 150 divides the read field data FDa into four, and transmits the four pieces of field data FDb after the division to the respective corresponding liquid crystal timing controllers 200. Since the data read from the memory 190 is divided into the four systems to be outputted in this manner, the data for one field per one system is 480×270×30 bits. That is, in each of the HDMI cables connecting the first circuit substrate 10, which has the signal processing circuit 100, and the second circuit substrate 20, which has the liquid crystal timing controllers 200, the data (the field data FDb) of 480×270×30 bits is transmitted per field.

<2.3 Effect>

According to the present embodiment, as in the first embodiment, the display device employing the field sequential system can be realized, that can normally transfer the field data (the video data for field sequential) FD among a plurality of substrates through the interface of the HDMI standard.

3. Third Embodiment

<3.1 Whole Configuration and Operation Outline>

A third embodiment of the present invention will be described. Since a whole configuration and an operation outline are similar to the first embodiment, description thereof will be omitted.

<3.2 Signal Processing Circuit>

Figure 21:
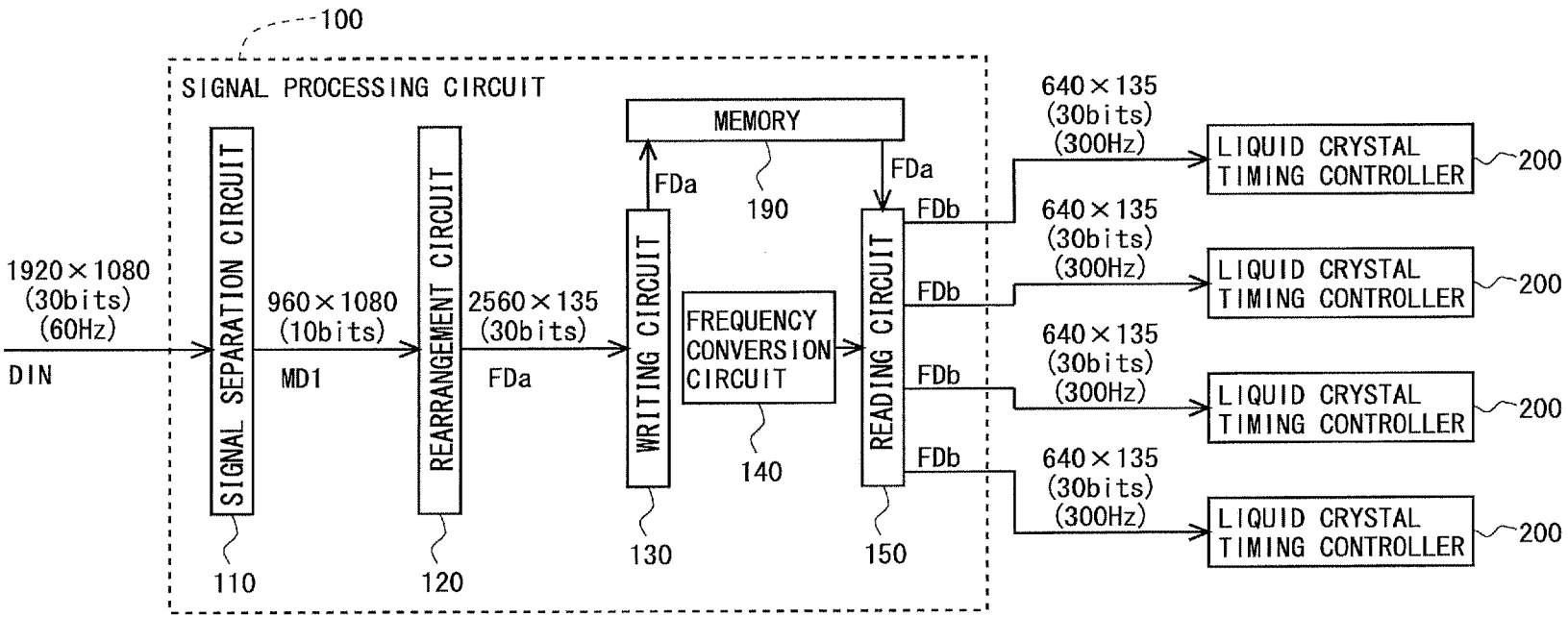
FIG. 21 is a block diagram for illustrating details of a signal processing circuit in a third embodiment of the present invention.

FIG. 21 is a block diagram for illustrating details of a signal processing circuit in the third embodiment of the present invention. It should be noted that, as to points similar to the first embodiment, description thereof will be omitted in some cases.

The signal separation circuit 110 generates first intermediate data MD1 of 960×1080×10 bits as schematically represented in FIG. 9 by separating an input image signal DIN into data for five fields as in the first embodiment. It should be noted that the first intermediate data MD1 for five fields is generated per one frame.

A format conversion portion 121 in the rearrangement circuit 120 converts the first intermediate data MD1 generated by the signal separation circuit 110 to data having a format conforming to an HDMI standard. Thus, second intermediate data MD2 is generated. Specifically, as in the first embodiment, the format conversion portion 121 in the rearrangement circuit 120 converts the first intermediate data MD1 of 960×1080×10 bits to second intermediate data MD2 of 320×1080×30 bits. The second intermediate data MD2 is schematically represented as shown in FIG. 12. Data for one pixel in FIG. 12 is 30 bits.

A data aggregation portion 122 in the rearrangement circuit 120 performs rearrangement of the second intermediate data MD2, lest a size of a column of the field data FDb to be transmitted from the signal processing circuit 100 to each of the liquid crystal timing controllers 200 should be too small. This rearrangement generates field data FDa.

Figure 22:
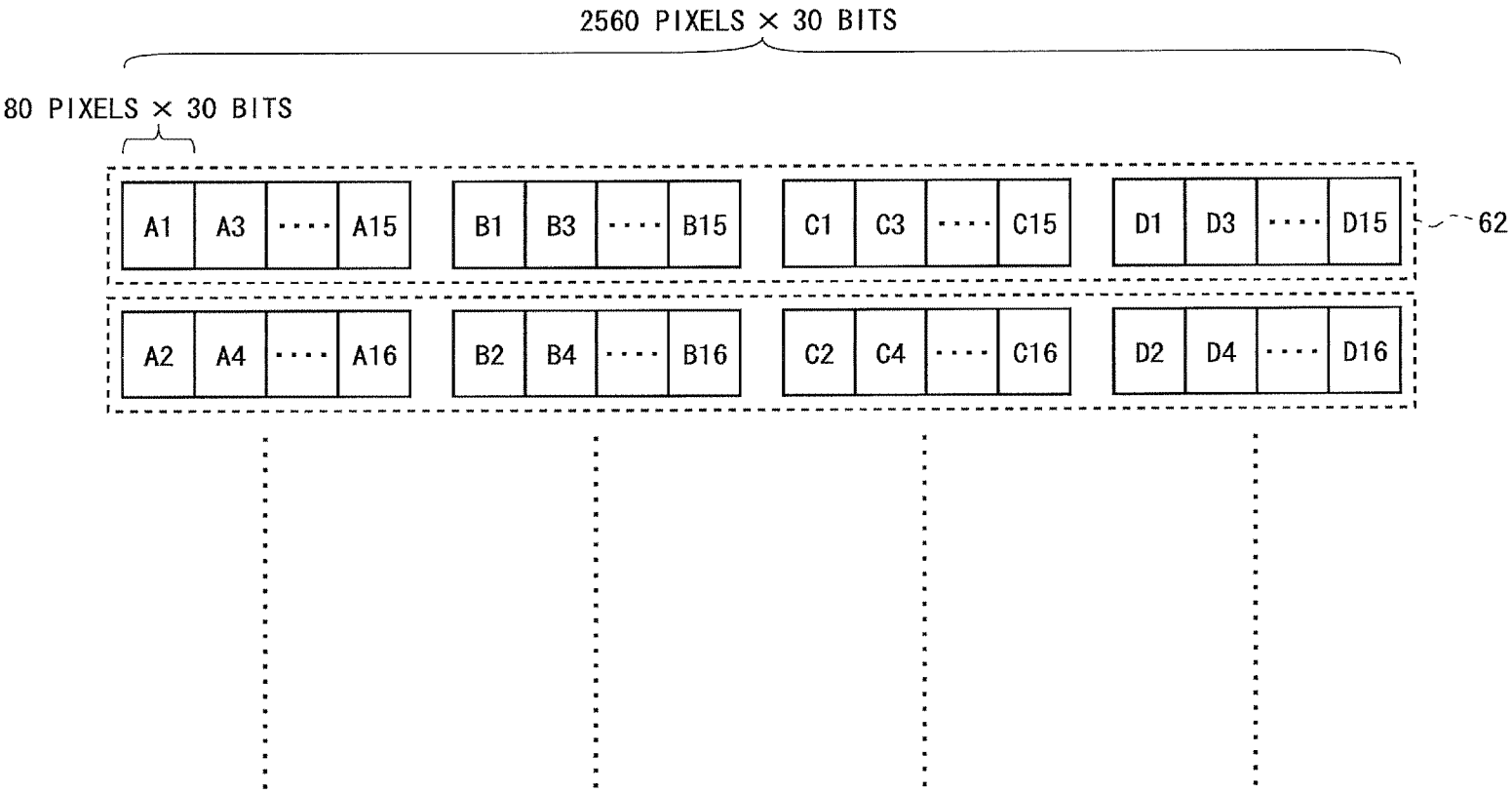
FIG. 22 is a diagram for illustrating processing of the signal processing circuit in the third embodiment.

Here, referring to FIGS. 12, 13 and 22, the rearrangement of the second intermediate data MD2 will be described in detail. As described above, the second intermediate data MD2 is schematically represented as shown in FIG. 12. As understood from FIG. 12, as to the second intermediate data MD2, the size of the column is 320. In the above-described first embodiment, the size of the column with respect to the field data FDb outputted from the reading circuit 150 and the size of the column with respect to the second intermediate data MD2 are made the same. That is, the size of the column with respect to the field data FDb is 320. However, even though the size of the column is 320, there are cases that, in some HDMI cables, the data transfer is not normally performed. Consequently, in the present embodiment, the data aggregation portion 122 in the rearrangement circuit 120 performs processing for putting data for 16 rows together as data for two rows.

Regarding the data as represented in FIG. 12, as in the above-described first embodiment, the data of every 80 pixels are represented by "A1", "B1", "C1", "D1", "A2" or the like for convenience, as shown in FIG. 13. In the present embodiment, as shown in FIG. 22, the data for eight rows on every other row is put together as data for one row. For example, the data denoted by reference character 62 in FIG. 22 is data obtained by putting the data in the 1st, 3rd, 5th, 7th, 9th, 11th, 13th, and 15th rows together as one row. It should be noted that, since the data for eight rows on every other row is put together as the data for one row in this manner, in conclusion, the data for 16 rows is put together as the data for two rows, as described above. The data represented by "A1" or the like in FIG. 22 is data of 80×30 bits. Moreover, since the data for eight rows is put together as the data for one row, the size of the row with respect to the data after the rearrangement becomes ⅛ of the size of the row with respect to the data before the rearrangement. Accordingly, the rearrangement is applied to the second intermediate data MD2 of 320×1080×30 bits by the data aggregation portion 122 in the rearrangement circuit 120, by which the field data FDa of 2560×135×30 bits is generated.

A writing circuit 130 writes, in the memory 190, the field data FDa generated by the rearrangement circuit 120. Thereby, every time the input image signal DIN for one frame is inputted, five pieces of field data FDa are written in the memory 190, each field data FDa being 2560×135×30 bits. A frequency conversion circuit 140 controls the operation of the reading circuit 150 so that the reading of the data by the reading circuit 150 is performed at 300 Hz.

The reading circuit 150 reads the field data FDa written in the memory 190 at the frequency of 300 Hz. The reading circuit 150 divides the read field data FDa into four, and transmits the four pieces of field data FDb after the division to the respective corresponding liquid crystal timing controllers 200. Since the data read from the memory 190 is divided into the four systems to be outputted in this manner, the data for one field per one system is 640×135×30 bits. That is, in each of the HDMI cables connecting the first circuit substrate 10, which has the signal processing circuit 100, and the second circuit substrate 20, which has the liquid crystal timing controllers 200, the data (the field data FDb) of 640×135×30 bits is transmitted per field.

<3.3 Effect>

According to the present embodiment, as in the first embodiment, the display device employing the field sequential system can be realized, that can normally transfer the field data (the video data for field sequential) FD among a plurality of substrates through the interface of the HDMI standard.

4. Fourth Embodiment

<4.1 Whole Configuration and Operation Outline>

A fourth embodiment of the present invention will be described. Since a whole configuration and an operation outline are similar to the first embodiment, description thereof will be omitted.

<4.2 Signal Processing Circuit>

Figure 23:
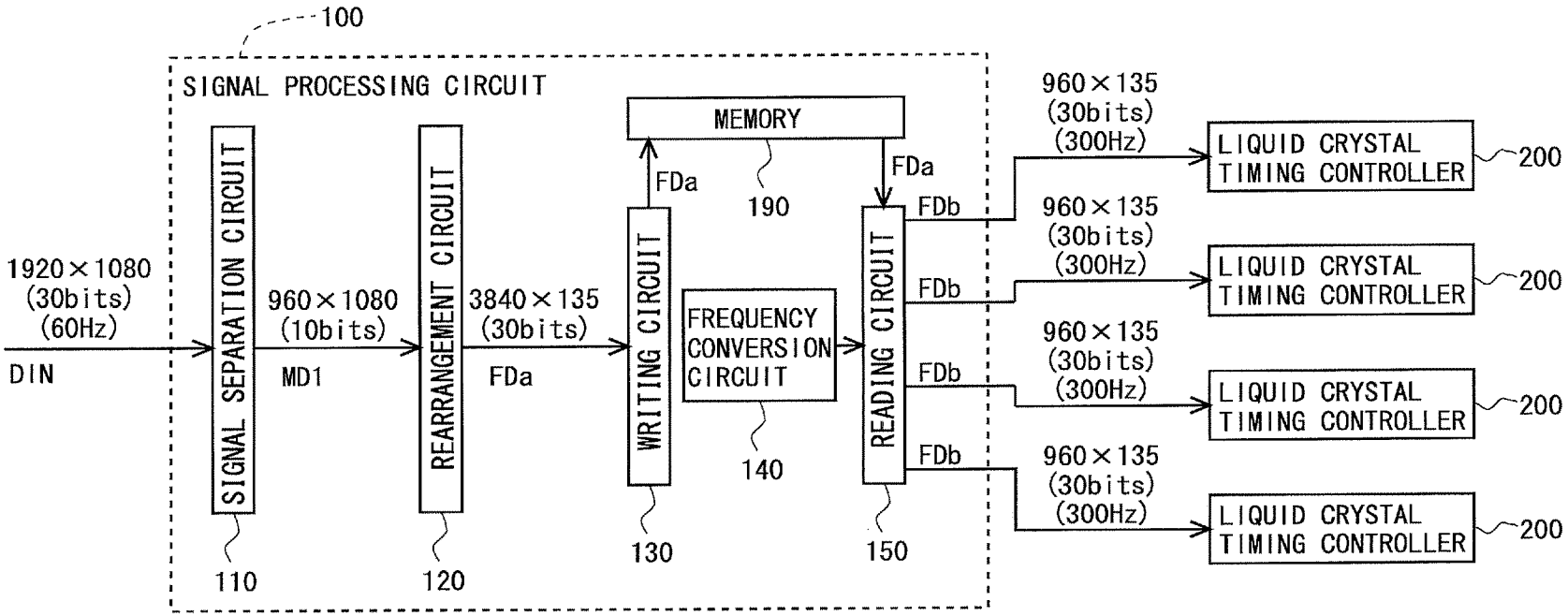
FIG. 23 is a block diagram for illustrating details of a signal processing circuit in a fourth embodiment of the present invention.

FIG. 23 is a block diagram for illustrating details of a signal processing circuit in the fourth embodiment of the present invention. As to points similar to the above-described embodiments, description thereof will be omitted in some cases.

The signal separation circuit 110 generates first intermediate data MD1 of 960×1080×10 bits as schematically represented as shown in FIG. 9 by separating an input image signal DIN into data for five fields as in the first embodiment. It should be noted that the first intermediate data MD1 for five fields is generated per one frame.

A format conversion portion 121 in the rearrangement circuit 120 converts the first intermediate data MD1 generated by the signal separation circuit 110 to data having a format conforming to an HDMI standard. Thus, second intermediate data MD2 is generated. Specifically, similarly to the second embodiment, the format conversion portion 121 in the rearrangement circuit 120 converts the first intermediate data MD1 of 960×1080×10 bits to second intermediate data MD2 of 480×1080×30 bits. The second intermediate data MD2 is schematically represented as shown in FIG. 18. Data for one pixel in FIG. 18 is 30 bits.

A data aggregation portion 122 in the rearrangement circuit 120 performs rearrangement of the second intermediate data MD2, lest a size of a column of field data FDb to be transmitted from the signal processing circuit 100 to each of the liquid crystal timing controllers 200 should be too small. This rearrangement generates field data FDa.

Here, referring to FIGS. 18, 19 and 24, the rearrangement of the second intermediate data MD2 will be described in detail. As described above, the second intermediate data MD2 is schematically represented as shown in FIG. 18. Regarding the data as represented in FIG. 18, as in the second embodiment, the data of every 120 pixels are represented by "A1", "B1", "C1", "D1", "A2" or the like for convenience, as shown in FIG. 19. In the present embodiment, as in the third embodiment, the data aggregation portion 122 in the rearrangement circuit 120 performs processing for putting the data for 16 rows together as the data for two rows.

Figure 24:
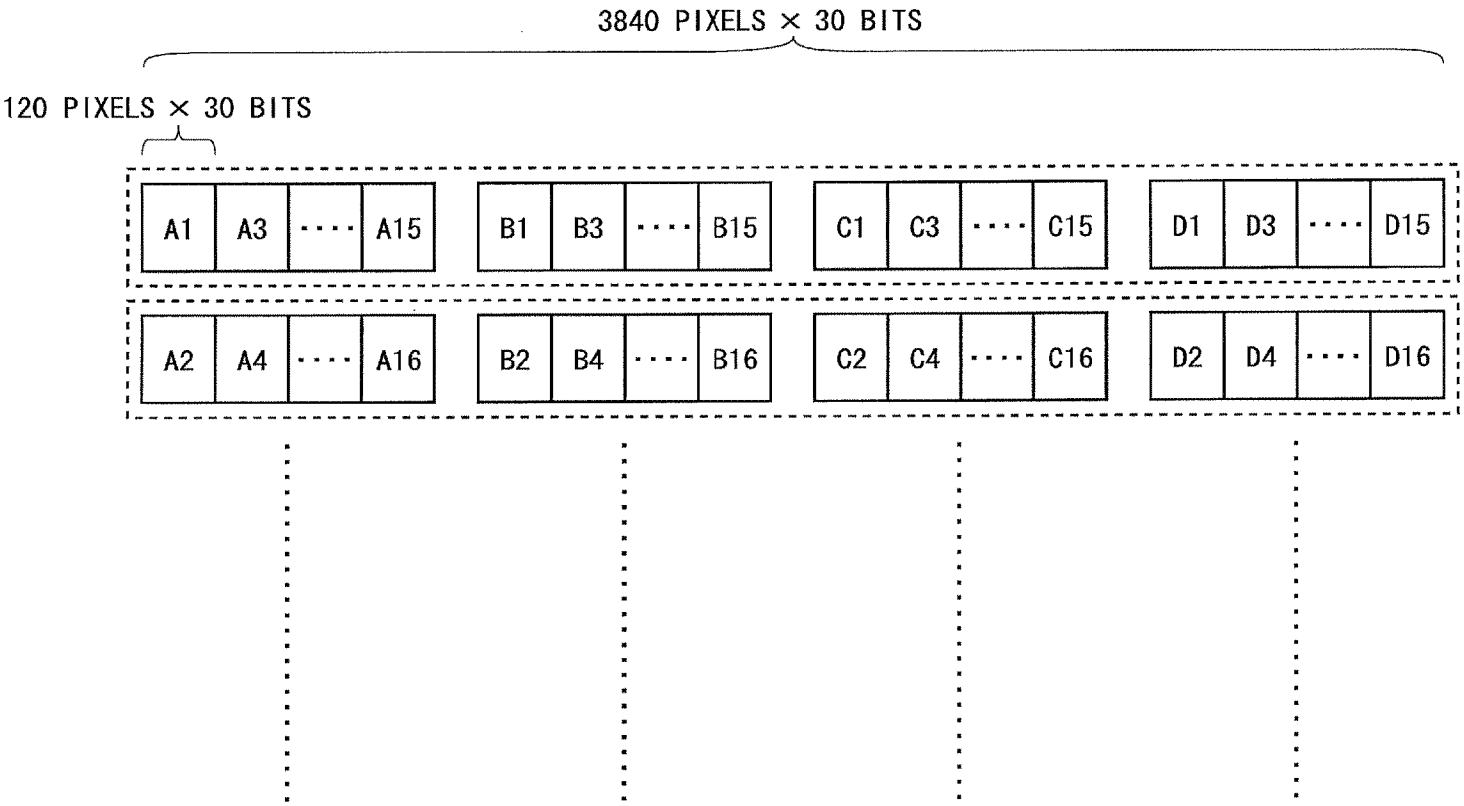
FIG. 24 is a diagram for illustrating processing of the signal processing circuit in the fourth embodiment.

In the present embodiment, as shown in FIG. 24, the data for eight rows on every other row is put together as the data for one row. Since the data for eight rows on every other row is put together as the data for one row In this manner, in conclusion, the data for 16 rows is put together as the data for two rows, as described above. The data represented by "A1" and the like in FIG. 24 is data of 120×30 bits. Moreover, since the data for eight rows is put together as the data for one row, the size of the row with respect to the data after the rearrangement becomes ⅛ of the size of the row with respect to the data before the rearrangement. Accordingly, the rearrangement is applied to the second intermediate data MD2 of 480×1080×30 bits by the data aggregation portion 122 in the rearrangement circuit 120, by which the field data FDa of 3840×135×30 bits is generated.

The writing circuit 130 writes, in the memory 190, the field data FDa generated by the rearrangement circuit 120. Thereby, every time the input image signal DIN for one frame is inputted, five pieces of field data FDa are written in the memory 190, each field data FDa being 3840×135×30 bits. A frequency conversion circuit 140 controls the operation of the reading circuit 150 so that the reading of the data by the reading circuit 150 is performed at 300 Hz.

The reading circuit 150 reads the field data FDa written in the memory 190 at the frequency of 300 Hz. The reading circuit 150 divides the read field data FDa into four, and transmits the four pieces of field data FDb after the division to the respective corresponding liquid crystal timing controllers 200. Since the data read from the memory 190 is divided into the four systems to be outputted in this manner, the data for one field per one system is 960×135×30 bits. That is, in each of the HDMI cables connecting the first circuit substrate 10, which has the signal processing circuit 100, and the second circuit substrate 20, which has the liquid crystal timing controllers 200, the data (the field data FDb) of 960×135×30 bits is transmitted per field.

<4.3 Effect>

According to the present embodiment, as in the first embodiment, the display device employing the field sequential system can be realized, that can normally transfer the field data (the video data for field sequential) FD among a plurality of substrates through the interface of the HDMI standard.

5. Others

The present invention is not limited to the above-described embodiments. Various modifications can be made as long as they do not deviate from the scope of the present invention. For example, in the above-described embodiments, the data transfer between the first circuit substrate 10 and the second circuit substrate 20 (the data transfer between the signal processing circuit 100 and the liquid crystal timing controllers 200) is performed through the interface conforming to the HDMI standard. However, the present invention is not limited thereto. The data transfer between the first circuit substrate 10 and the second circuit substrate 20 may be performed through an interface conforming to a standard other than the HDMI standard (e.g., the DVI standard).

Moreover, in the above-described embodiments, the one frame period is divided into five fields. However, the present invention is not limited thereto. One frame period may be divided into a number other than five (e.g., four fields). Further, while in the above-described embodiments, description has been given, taking the liquid crystal display device as an example, a display device other than the liquid crystal display device (e.g., an organic EL display device) can also be applied to the present invention.

DESCRIPTION OF REFERENCE CHARACTERS

10: FIRST CIRCUIT SUBSTRATE
20: SECOND CIRCUIT SUBSTRATE
100: SIGNAL PROCESSING CIRCUIT
110: SIGNAL SEPARATION CIRCUIT
120: REARRANGEMENT CIRCUIT
130: WRITING CIRCUIT
140: FREQUENCY CONVERSION CIRCUIT
150: READING CIRCUIT
190: MEMORY
200: LIQUID CRYSTAL TIMING CONTROLLER
310: GATE DRIVER
320: SOURCE DRIVER
330: LED DRIVER
400: LIQUID CRYSTAL PANEL
410: DISPLAY PORTION
490: BACKLIGHT
DIN: INPUT IMAGE SIGNAL
MD1: FIRST INTERMEDIATE DATA
MD2: SECOND INTERMEDIATE DATA
FD, FDa, FDb: FIELD DATA

The invention claimed is:

1. A display device employing a field sequential system configured to perform color display by dividing one frame period into a plurality of fields and displaying a different in each color field, the display device comprising:

a display panel configured to display an image;

a first circuit substrate having a signal processing circuit configured to generate field data as data on a field basis by performing signal processing to an input image signal; and a second circuit substrate having a circuit configured to perform processing for causing the display panel to display an image based on the field data transmitted from the first circuit substrate, wherein the field data is transmitted from the first circuit substrate to the second circuit substrate through a plurality of cables having a standardized interface, and the signal processing circuit includes:

a signal separation circuit configured to separate the input image signal for one frame period into first intermediate data on a field basis;

a rearrangement circuit configured to generate the field data by converting the first intermediate data to second intermediate data having a format based on the standardized interface and by rearranging the second intermediate data so that data for a plurality of rows is simulatively put together as data for one row; and a field data output circuit configured to output the field data to the second circuit substrate at a frequency based on a number of fields configuring one frame period.

2. The display device according to claim 1, wherein a plurality of timing control circuits configured to control operation of a panel drive circuit that drives the display panel are mounted on the second circuit substrate, the timing control circuits being connected to the respective plurality of cables, and the plurality of timing control circuits return arrangement order of data included in field data outputted from the field data output circuit to arrangement order before the rearrangement by the rearrangement circuit is performed.

3. The display device according to claim 1, wherein the field data output circuit comprises:

a memory;

a writing circuit configured to write in the memory the field data generated by the rearrangement circuit; and a reading circuit configured to read field data written in the memory at a frequency based on a number of fields configuring one frame period, and to output the read field data to the second circuit substrate.

4. The display device according to claim 1, wherein the rearrangement circuit converts the first intermediate data to the second intermediate data including red, green, and blue data simulatively.

5. The display device according to claim 1, wherein when the data for the plurality of rows is simulatively put together as the data for one row by the rearrangement circuit, data of every n-th (n is a natural number) row is put together as data for one row.

6. The display device according to claim 1, wherein a number of fields configuring one frame period is four or more.

7. The display device according to claim 1, wherein the standardized interface is a high-definition multimedia interface.

8. The display device according to claim 1, wherein the standardized interface is a digital visual interface.

9. A method for processing data in a display device employing a field sequential system including a display panel configured to display an image, a first circuit substrate, and a second circuit substrate, the display device being configured to perform color display by dividing one frame period into a plurality of fields and displaying a different color in each field, the method comprising:

a signal processing step of generating field data as data on a field basis by performing signal processing to an input image signal in the first circuit substrate; and a display control step of performing, in the second circuit substrate, processing for causing the display panel to display an image based on the field data transmitted from the first circuit substrate, wherein the field data is transmitted from the first circuit substrate to the second circuit substrate through a plurality of cables having a standardized interface, and the signal processing step includes:

a signal separation step of separating the input image signal for one frame period into first intermediate data on a field basis;

a rearrangement step of generating the field data by converting the first intermediate data to second intermediate data having a format based on the standardized interface and by rearranging the second intermediate data so that data for a plurality of rows is simulatively put together as data for one row; and a field data output step of outputting the field data to the second circuit substrate at a frequency based on a number of fields configuring one frame period.

* * * * *